US005129236A

United States Patent [19]

Solomon

[11] Patent Number: 5,129,236

[45] Date of Patent: Jul. 14, 1992

[54] HEAT PUMP SYSTEM

[76] Inventor: Fred D. Solomon, 979 Meadow Park Dr., Akron, Ohio 44313

[21] Appl. No.: 578,425

[22] Filed: Sep. 6, 1990

[51] Int. Cl.[5] ..... F25B 27/00

[52] U.S. Cl. ..... 62/324.1; 62/235.1; 62/238.4; 62/236; 417/383

[58] Field of Search ..... 62/236, 235.1, 324.1, 62/335, 238.4, 323.2; 417/375, 379, 383

[56] References Cited

U.S. PATENT DOCUMENTS

| | | | |
|---|---|---|---|
| Re. 27,740 | 8/1973 | Schuman | 417/207 |
| 821,926 | 5/1906 | Cornish | 417/375 |
| 2,101,495 | 12/1937 | Ferris et al. | 62/236 |
| 2,370,068 | 2/1945 | Palm | 91/346 X |
| 2,637,304 | 5/1953 | Dinkelkamp | 91/346 X |
| 2,641,187 | 6/1953 | Adams | 91/347 X |
| 2,688,923 | 8/1954 | Bonaventure et al. | 417/379 |
| 3,309,012 | 3/1967 | Booth et al. | 417/379 |
| 3,937,599 | 2/1976 | Thureau et al. | 417/389 |
| 3,960,322 | 6/1976 | Ruff et al. | 62/236 |
| 3,994,132 | 11/1976 | Jackson | 60/325 |
| 4,068,476 | 1/1978 | Kelsey | 60/671 |
| 4,103,493 | 8/1978 | Schoenfelder | 62/235.1 |
| 4,110,986 | 9/1978 | Tacchi | 60/641 |
| 4,213,305 | 7/1980 | De Geus | 62/235.1 |
| 4,220,139 | 9/1980 | Ramsden | 126/422 X |
| 4,227,866 | 10/1980 | Stubbs | 417/379 |
| 4,232,655 | 11/1980 | Frissora et al. | 126/422 X |
| 4,266,404 | 5/1981 | El Difrawi | 62/238.4 |
| 4,666,376 | 5/1987 | Solomon | 417/379 |
| 4,762,170 | 8/1988 | Nijjar et al. | 62/236 |
| 4,977,752 | 12/1990 | Hanson | 62/236 |

*Primary Examiner*—Albert J. Makay
*Assistant Examiner*—William C. Doerrler
*Attorney, Agent, or Firm*—Renner, Kenner, Greive, Bobak, Taylor & Weber

[57] ABSTRACT

A heat pump system (10, 210) includes a power section (11, 211) having a generator (15, 215) for converting a first working fluid from a liquid to a relatively high pressure gas, a power unit (25, 222) providing energy by the conversion of the relatively high pressure gas to relatively low pressure gas to power a drive piston (27, 228') for intermittently delivering a power stroke, a power section condenser (51, 251) converting the first working fluid from relatively low pressure gas to the liquid, a compressor section (12, 212) intermittently driven by the drive piston, the compressor section having a compressor (75, 275) converting relatively low pressure gas second working fluid to relatively high pressure gas second working fluid for circulating the second working fluid through a compressor section condensor (108, 308) and a compressor section evaporator (115, 315) to effect heating and cooling operations. A combined power unit and compressor assembly (221, 221') may be employed which has a valve assembly (232,332) for introducing the relatively high pressure gas to power the drive piston and for evacuating the relatively low pressure gas therefrom. A condensate pump (55, 255, 455) circulates the liquid in the power section.

51 Claims, 12 Drawing Sheets

HEAT PUMP SYSTEM

TECHNICAL FIELD

Generally, the invention relates to a heat pump system capable of providing heating and cooling requirements of the heating, ventilating, and air conditioning industry. More particularly, the invention relates to a heat pump system for providing such heating and cooling by heat driven apparatus. More specifically, the invention relates to a highly efficient heat pump system in which the pump or compressor is actuated by a motor or power unit which is heat driven.

BACKGROUND ART

Heat pumps have long been known and employed in the heating, ventilating, and air conditioning industry. A significant reason for the extensive use and focus of attention on heat pump systems is that the same components may be employed to effect both heating and cooling operations, whereas most other systems require a substantial number of separate equipment components for carrying out heating and cooling functions. Classically, heat pump systems employ a compressor which is operated by an electric motor to circulate refrigerant through a condenser which converts a gaseous form of the refrigerant to a liquid and an evaporator which absorbs heat from or imparts heat to an area to be cooled or heated, respectively, while converting the refrigerant from a liquid to a gaseous form.

For the most part, advancements in heat pump system technology have been directed to the development of improved working fluids and system components. In the case of working fluids, different refrigerants and particularly different fluorocarbon compounds have been developed which exhibit optimum performance characteristics in particular equipment or operating ranges. In regard to system components, efforts have been made to improve the operation and efficiency of the compressor, condenser, evaporator, and any ancillary components of these systems. However, due to the relatively advanced age and state of development of this technology, only minor improvements in operation and efficiency have been achieved through research and development efforts of this nature over the years.

In recent years, attempts have been made to develop heat pumps which are heat driven. In this respect, engine driven and absorption type heat pumps represent examples of efforts of this type. Heat driven heat pumps of these types have not achieved commercial acceptance and recognition for a number of reasons. In general, devices of this nature tend to be highly complex systems having component elements which are both sophisticated and expensive. In addition, many of these systems contemplate the use of working fluids which are other than conventional refrigerants, such as ammonia or lithium bromide. Due to the fact that ammonia, for example, is considered to be a noxious gas, the use of nonconventional working fluids of this nature requires radically new and different capabilities and equipment with respect to installation, repair, and service personnel than is normally involved in the heating, ventilating, and air conditioning industry. With the technical limitations on working fluid and component improvements and the lack of commercial acceptance of heat driven heat pump systems, heat pump systems have remained in essentially the same technological state of development for a substantial number of years.

DISCLOSURE OF THE INVENTION

Therefore an object of the present invention is to provide a heat pump system which may be exclusively heat driven. Another object of the present invention is to provide such a heat pump system wherein refrigerant in a power section is vaporized in a generator or evaporator by any heat source, such as a high efficiency gas boiler. Still another object of the invention is to provide such a heat pump system which may readily employ a plurality of heat sources including, for example, an array of solar collectors.

Another object of the present invention is to provide a heat pump system having a power section and a compressor section. A further object of the present invention is to provide such a heat pump system wherein the compressor section includes a unique compressor according to the present invention and the other standard components of a conventional heat pump installation. Yet another object of the present invention is to provide such a heat pump system wherein the power section has a power unit or drive assembly which supplies actuating fluid to the compressor and also supplies actuating fluid to operate a condensate pump in the power section.

Still another object of the present invention is to provide a heat pump system which employs a combination of a Rankine cycle and a vapor compression cycle. A still further object of the invention is to provide such a heat pump system wherein the power section is a Rankine cycle employing a refrigerant and the compressor section is a vapor compression cycle also employing a refrigerant. Yet another object is to provide such a heat pump system wherein the compressor section, except for the compressor, may employ standard components of a conventional heat pump system which achieve a high coefficient of performance with a limited quantity of equipment, available at relatively reasonable costs. Still a further object of the invention is to provide such a heat pump system wherein heat exchangers are strategically located between lines in the power section and between lines in the power section and compressor section, thereby significantly improving the coefficient of performance of the system.

Still a further object of the present invention is to provide a heat pump system wherein the compressor of the compressor section is hydraulically driven by the power unit or drive assembly of the power section. Another object of the invention is to provide such a heat pump system wherein the compressor includes a pair of connected pistons joined to the housing by rolling diaphragms. Yet a further object of the invention is to provide such a heat pump system wherein the pressurized working fluid supplied to the low pressure side of the compressor assists the hydraulic fluid from the power unit or drive assembly in operating the piston in the compression chamber, thereby reducing the pressure requirements of the hydraulic fluid supplied by the power unit or drive assembly for a given pressure increase in the working fluid. Still another object of the invention is to provide such a heat pump system wherein the two pistons of the compressor each have a pair of spaced diaphragms each having a vacuum connection there between to preclude distortion and maintain the rolling diaphragms in convolutions.

Yet another object of the invention is to provide a heat pump system compressor which can withstand quantities of unvaporized fluid with no deleterious effects, whereby the extent of superheating of the working fluid is not critical and can, therefore, be reduced to increase system efficiency. A further object of the invention is to provide such a compressor having a piston diaphragm configuration which exhibits very low rolling friction between the pistons and the housings while having the capability of withstanding relatively high pressures. Still another object of the invention is to provide such a compressor which may be designed for operation at a relatively low stroke repetition rate on the order of thirty (30) to forty (40) strokes per minute which serves to extend the service life of the diaphragms.

Yet another object of the present invention is to provide a heat pump system which meets or exceeds the performance efficiency of other known systems currently in use taking into consideration the cost of the fuel or power supplied to the system. Still another object of the invention is to provide such a heat pump system which is relatively inexpensive to acquire in relation to existing systems and which can be maintained by service personnel based substantially upon existing training levels. Yet a further object of the invention is to provide such a heat pump system which can be readily serviced and which employs working fluids which are standard refrigerants commonly used in the heating, air conditioning, and ventilating industry.

A further object of the present invention is to provide a second embodiment of the heat pump system wherein the power unit or drive of the power section and the compressor of the compressor section are a combined or consolidated unit. Another object of this embodiment of the heat pump system is to provide such a combined drive and compressor assembly which does not require a hydraulic fluid interconnection between the drive and compressor. Still another object of this embodiment of the heat pump system is to provide such a combined drive and compressor assembly wherein the pistons of the drive and compressor are mechanically interconnected. Yet another object of this embodiment of the heat pump system is to provide such a combined drive and compressor assembly which reduces the number of pistons and rolling diaphragms required in relation to the number employed in the heat pump system of the first embodiment of the present invention.

A further object of the present invention is to provide a second embodiment of the heat pump system, wherein a valve controls the ingress and egress of fluids to the power piston. Another object of this embodiment of the heat pump system is to provide such a valve which requires a predetermined pressure of ingress fluid to the power piston chamber to effect a selected displacement of the piston before the piston chamber is connected for exhausting fluid from the piston chamber. Yet another object of this embodiment of the heat pump system is to provide such a valve which is biased to effect rapid actuation between the operating positions thereof and which employs movement of the connecting rod of the power piston to initiate actuation between the operating positions. Still another object of this embodiment of the heat pump system is to provide such a valve in which seals for all moving elements are located internally of the power piston chamber to thereby preclude the escape of freon or other refrigerant from the system. A still further object is to provide such a valve which employs a ceramic valve element that eliminates the need for conventional seals.

A further object of the present invention is to provide an alternate condensate pump of the power section which is incorporated or combined into the combined power unit and compressor of the second embodiment of the invention. Another object of this alternate condensate pump is to provide such a combined condensate pump and drive and compressor assembly which does not require a fluid interconnection between the drive and the condensate pump. Still another object of this alternate condensate pump is to provide such a combined condensate pump and drive and compressor assembly wherein the condensate pump cylinder is actuated by mechanical interconnection with the piston of the driver. Yet another object of this alternate condensate pump is to provide such a combined condensate pump and drive and compressor assembly which reduces the number of pistons and rolling diaphragms required in relation to the number employed in the heat pump systems of the first and second embodiments of the present invention.

Another object of the present invention is to provide an alternate valve which is incorporated into the power piston of the second embodiment of the invention to control the ingress and egress of fluids thereto. A further object of this alternate valve is to provide a valve which is biased to effect rapid actuation between the operating positions thereof. Yet another object of this alternate valve is to provide a valve in which seals for all moving elements are located internally of the power piston chamber to thereby preclude the escape of freon or other refrigerant from the system. Still another object of this alternate valve is to provide a shuttle valve which is mounted on and moves relative to the connecting rod of the power piston to effect actuation between operating positions and which employs movement of the connecting rod of the power piston to initiate actuation between operating positions.

A further object of the present invention is to provide an alternate condensate pump which is incorporated into the second embodiment of the invention having the alternate valve configuration. A further object of the invention is to provide such a condensate pump which is incorporated into the combined power unit and compressor assembly of the power section of the heat pump system. Yet another object of the present invention is to provide such a condensate pump which is physically integrated into the power piston and connecting rod of the combined power unit and compressor assembly. Yet another object of the invention is to provide such a condensate pump which requires no lines interconnecting the condensate pump with the combined power unit and compressor assembly. Yet another object of the invention is to provide such a condensate pump which employs only a single piston. Still another object of the invention is to provide such a condensate pump incorporated into the power piston and connecting rod of the power unit and compressor assembly having a stationary piston and a cylinder casing movable with the connecting rod and power piston.

In general, the present invention contemplates a heat pump system including a power section having a generator for converting a first working fluid from a liquid to a relatively high pressure gas, a power unit providing energy by the conversion of the relatively high pressure gas to relatively low pressure gas to power a drive piston for intermittently delivering a power stroke, a power section condenser converting the first working fluid from relatively low pressure gas to the liquid, a compressor section intermittently driven by the drive piston, the compressor section having a compressor converting relatively low pressure gas second working fluid to relatively high pressure gas second working fluid for circulating the second working fluid through a compressor section condenser and a compressor section evaporator to effect heating and cooling operations. A combined power unit and compressor assembly may be employed which has a valve assembly for introducing the relatively high pressure gas to power the drive piston and for evacuating the relatively low pressure gas therefrom. A condensate pump circulates the liquid in the power section.

PREFERRED EMBODIMENT FOR CARRYING OUT THE INVENTION

Figure 1:
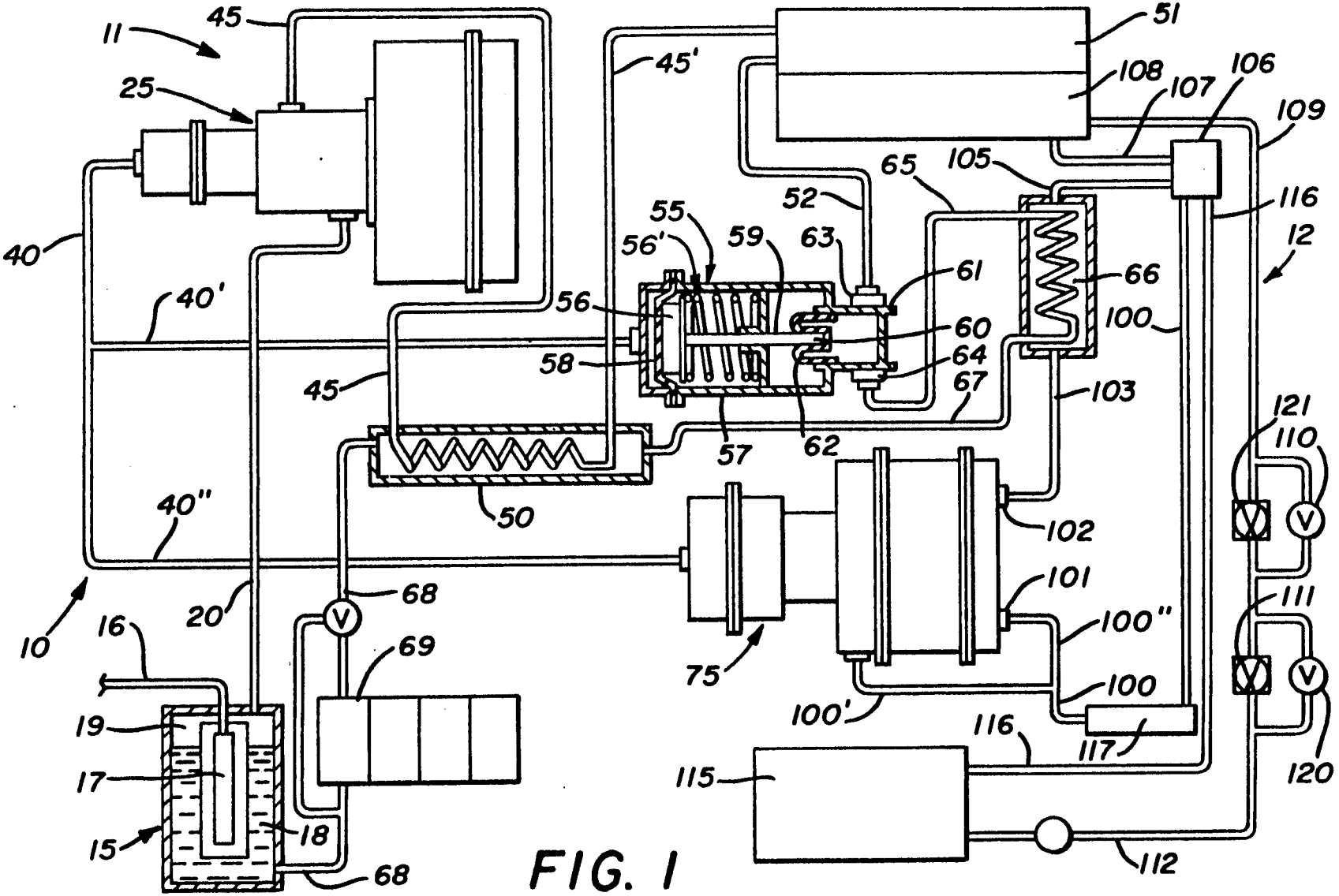
FIG. 1 is a largely schematic depiction of an exemplary heat pump system embodying the concepts of the present invention, with schematic depictions of primary internal operating elements of certain of the components.

An exemplary heat pump system embodying the concepts of the present invention is generally denoted by the numeral 10 in FIG. 1 of the accompanying drawings. The heat pump system 10 has a power section, generally indicated by the numeral 11, which drives and otherwise interrelates with a compressor section, generally indicated by the numeral 12. As will be appreciated from the following description, the power section 11 employs a Rankine cycle, and the compressor section 12 employs a vapor compression cycle.

The power section 11 converts heat supplied to the system 10 to work in the form of pressurized fluid which drives other components of the system. The power section 11 has a generator or evaporator, generally indicated by the numeral 15, which receives a fuel and air mixture through a fuel inlet line 16 which is ignited in a burner 17 to heat a working fluid 18 in the generator 15. While the arrangement shown in FIG. 1 contemplates the usage of a high efficiency gas boiler as the generator 15, it is to be appreciated that other heat sources could be employed, depending on fuel availability and cost, in lieu of the generator 15 to effect heating of liquid working fluid 18 in generator 15 and conversion to a saturated vapor condition in an expansion chamber 19 of the generator 15.

A preferred working fluid for the power section 11 contemplates the use of R-113 refrigerant. It is to be appreciated, however, that other fluoro-chloro hydrocarbon compounds or other refrigerants having comparable characteristics could be employed to carry out the present invention, depending upon operating characteristics of various system components.

The saturated vapor refrigerant is supplied via a power section high pressure gas line 20 to a power unit or drive assembly, generally indicated by the numeral 25. As shown, particularly in FIG. 2, the power unit 25 has an enlarged housing 26 which carries a power piston 27 which is attached to a connecting rod 28. The connecting rod 28 extends through the annular wall 29 of housing 26 into an intermediate housing 30 where it is attached to a drive piston 31 which extends into a reduced diameter housing 32. Both the power piston 27 and the drive piston 31 are provided with rolling diaphragms 33 and 34, respectively, which are attached to the pistons 27, 31 and internally of the housings 26 and 32.

The saturated vapor from generator 15 which is transported in power section high pressure gas line 20 is introduced into the drive assembly 25 by gas inlet tube 35 which is connected to shuttle valve spool 36 mounted on the connecting rod 28. The high pressure gas is transferred from interiorly of shuttle valve spool 36 through a radial passageway 37 and an axial passageway 38 in connecting rod 28, the latter of which terminates at the extremity of the connecting rod 28 within housing 26. This high pressure gas drives the power piston 27 to the left from the position as viewed in FIG. 2, thereby effecting displacement of connecting rod 28 and drive piston 31 to the left during the power stroke. This movement of the pistons 27, 31 displaces a working fluid which is preferably hydraulic oil from chamber 39 in housing 32 to the left of the diaphragm 34 through a hydraulic line 40 to components and for purposes to be described hereinafter.

Figure 2:
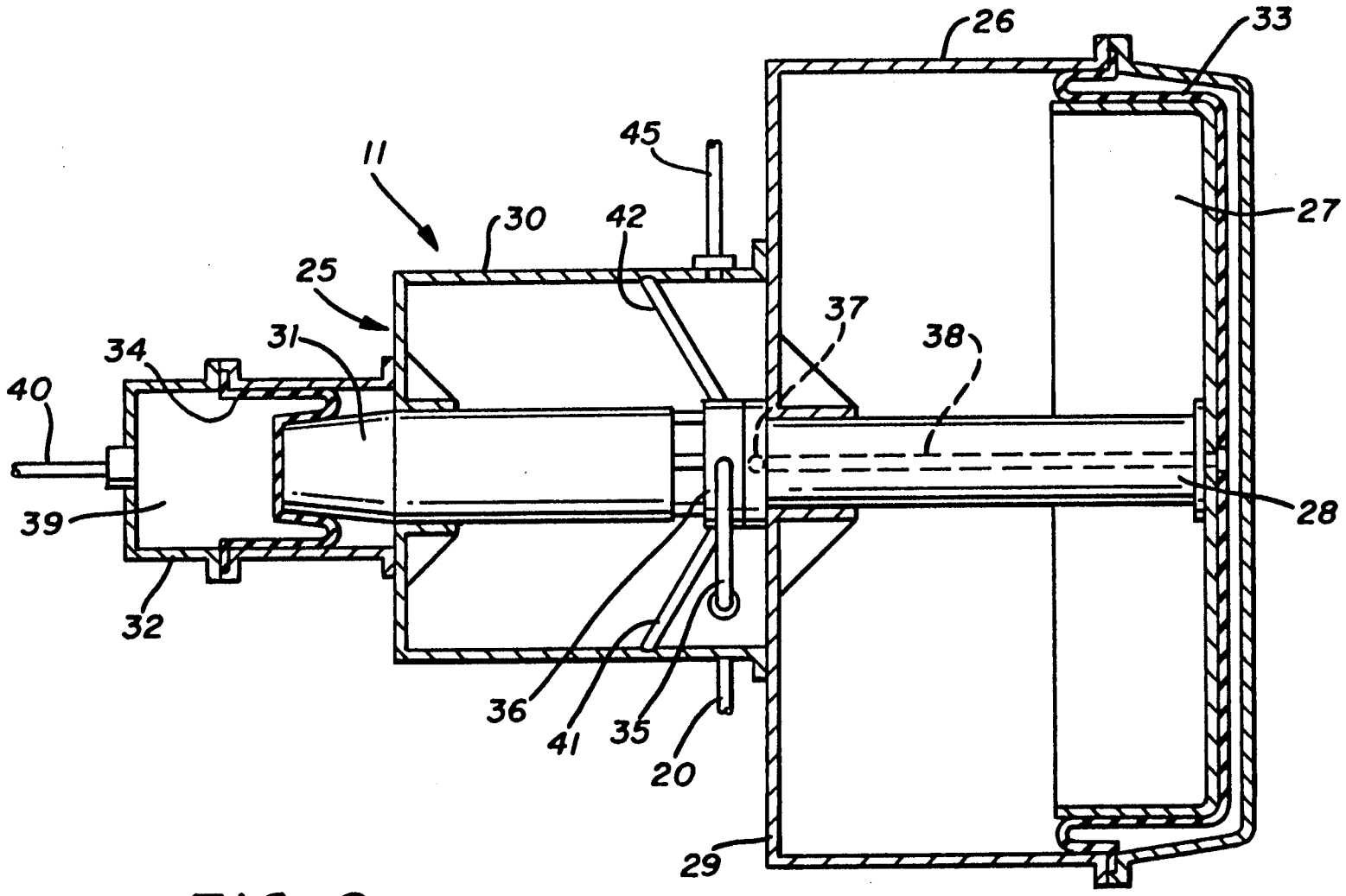
FIG. 2 is an enlarged partially schematic cross-sectional view of the power unit or drive assembly of the power section of the heat pump system of FIG. 1.

As the pistons 27, 31 and connecting rod 28 are moving to the left as viewed in FIG. 2 during the power stroke, a pair of radially inwardly biased snap arms 41 and 42 provide the force necessary to move the shuttle valve spool 36 along connecting rod 28 to a position where the radial passageway 37 in connecting rod 28 is uncovered by valve spool 36. Thus, the space to the right side of piston 27 in housing 26 is exhausted through the axial passageway 38 and radial passageway 37 into the intermediate housing 30 where it exits into a connecting power section low pressure gas line 45. The return stoke of pistons 27 and 31 to the position depicted in FIG. 2 of the drawing is effected by return of pressurized hydraulic oil to chamber 39 from hydraulic line 40 in a manner detailed hereinafter. Thus, the high pressure gaseous refrigerant entering power unit 25 employs a portion of its energy to intermittently drive power piston 27 to discharge hydraulic fluid through hydraulic line 40 with the reduced pressure gas being exhausted through power section low pressure gas line 45. Additional structural and operational details of the power unit 25 are detailed in my earlier U.S. Pat. No. 4,666,376 issued May 19, 1987, and entitled "Solar Powered Pump Assembly."

Referring again to FIG. 1 of the drawings, the lower pressure gas in power section low pressure gas line 45 is directed to a heat exchanger 50 where the temperature of the low pressure gas in low pressure gas line 45 is slightly reduced, with the other fluid passing through heat exchanger 50 being heated a comparable amount as set forth hereinafter. A reduced temperature power section low pressure gas line 45' connects the outlet of heat exchanger 50 with a condenser 51. The condenser 51 may be a conventional air conditioning condenser, wherein ambient air is blown over the surface of coils containing the reduced temperature low pressure gas to convert the gas into a liquid. The liquid exits condenser 51 through a low pressure liquid line 52 which is connected to a condensate pump, generally indicated by the numeral 55.

The condensate pump 55 is powered by the hydraulic fluid in a branch hydraulic line 40' of hydraulic line 40 which exits the power unit 25 as hereinabove described. The condensate pump 55 may be a relatively simple structural configuration wherein a power piston 56 connected to housing 57 by a rolling diaphragm 58 is joined to a connecting rod 59 which also carries a piston 60 operating in reduced diameter housing 61. The piston 60 may also have a rolling diaphragm 62 connecting it to housing 61.

Upon actuation of drive piston 31 during the power stroke of power unit 25, the power piston 56 of condensate pump 55 is displaced to the right from the position shown in FIG. 1, with the piston 60 being simultaneously displaced to the right in FIG. 1 within the housing 61. The low pressure liquid line 52 communicates interiorly of housing 61 through an inlet check valve 63. An outlet check valve 64 is also positioned in housing 61 and connects with a high pressure liquid line 65. It will, thus, be appreciated that during the power stroke of pistons 56 and 60 to the right from the position depicted in FIG. 1, the inlet check valve 63 will be closed and outlet check valve 64 will be open to permit the flow of pressurized fluid into the high pressure liquid line 65. The return stroke of the pistons 56, 60 to the left as depicted in FIG. 1 is accompanied by a reversal of operating positions of the valves 63, 64, such that the outlet check valve 64 will be closed and the inlet check valve 63 will be open to allow liquid from the low pressure liquid line 52 to enter housing 61 attendant return of the pistons 56, 60 to the position depicted in FIG. 1 during the return stroke of pistons 27, 31 of the power unit 25 when the hydraulic fluid in hydraulic line 40 is not pressurized, thus readying the condensate pump 55 for a further power stroke. If desired, a return spring 56' may be positioned on piston 56 to assist in effecting return stroke of the pistons 56, 60.

The high pressure liquid line 65 output from the condensate pump 55 is circulated to a heat exchanger 66 which is interconnected with a line in the compressor section 12 as is described hereinafter. The liquid in high pressure liquid line 65 undergoes a heat gain in passing through heat exchanger 66 with a commensurate heat loss in the compressor section 12. A higher temperature high pressure liquid line 67 outlets from the heat exchanger 66, and the liquid is further circulated to the heat exchanger 50 described hereinabove. As previously indicated, with the fluid in low pressure gas line 45 losing heat in the heat exchanger 50, the liquid in high pressure liquid line 67 gains heat and exits from the heat exchanger 50 into a liquid return line 68. It will, thus, be appreciated that the heat exchangers 66 and 50 operate to raise the temperature of liquid condensate from condenser 51 preparatory to reintroduction into the generator 15 via liquid return line 68. It will further be appreciated that these incremental temperature increases improve the efficiency of the system 10 in that a lesser temperature increase need be imparted for the liquid to gas change of state in generator 15.

Depending upon the operational requirements of a particular heat pump system 10, the geographic location and other considerations, the liquid condensate in condensate return line 68 may be further heated prior to introduction into the generator 15 to reduce the fuel consumption of the burner 17 in converting the liquid condensate 18 in generator 15 to a gaseous state in expansion chamber 19. To this end, a solar collector 69 constituted of one or more arrays having suitable interconnecting pipes might be interposed in condensate return line 68 as seen in FIG. 1 of the drawings. Also, supplemental heating might be supplied as a by-product of a manufacturing process if heat pump system 10 were to be installed in a manufacturing facility.

As seen in FIG. 1 of the drawings, the compressor section 12 of heat pump system 10 is driven by hydraulic fluid in a branch hydraulic line 40" of hydraulic line 40 which exits the power unit 25 as hereinabove described. As seen in FIG. 1, the branch hydraulic line 40" interconnects with a compressor, generally indicated by the numeral 75, of compressor section 12.

Figure 3:
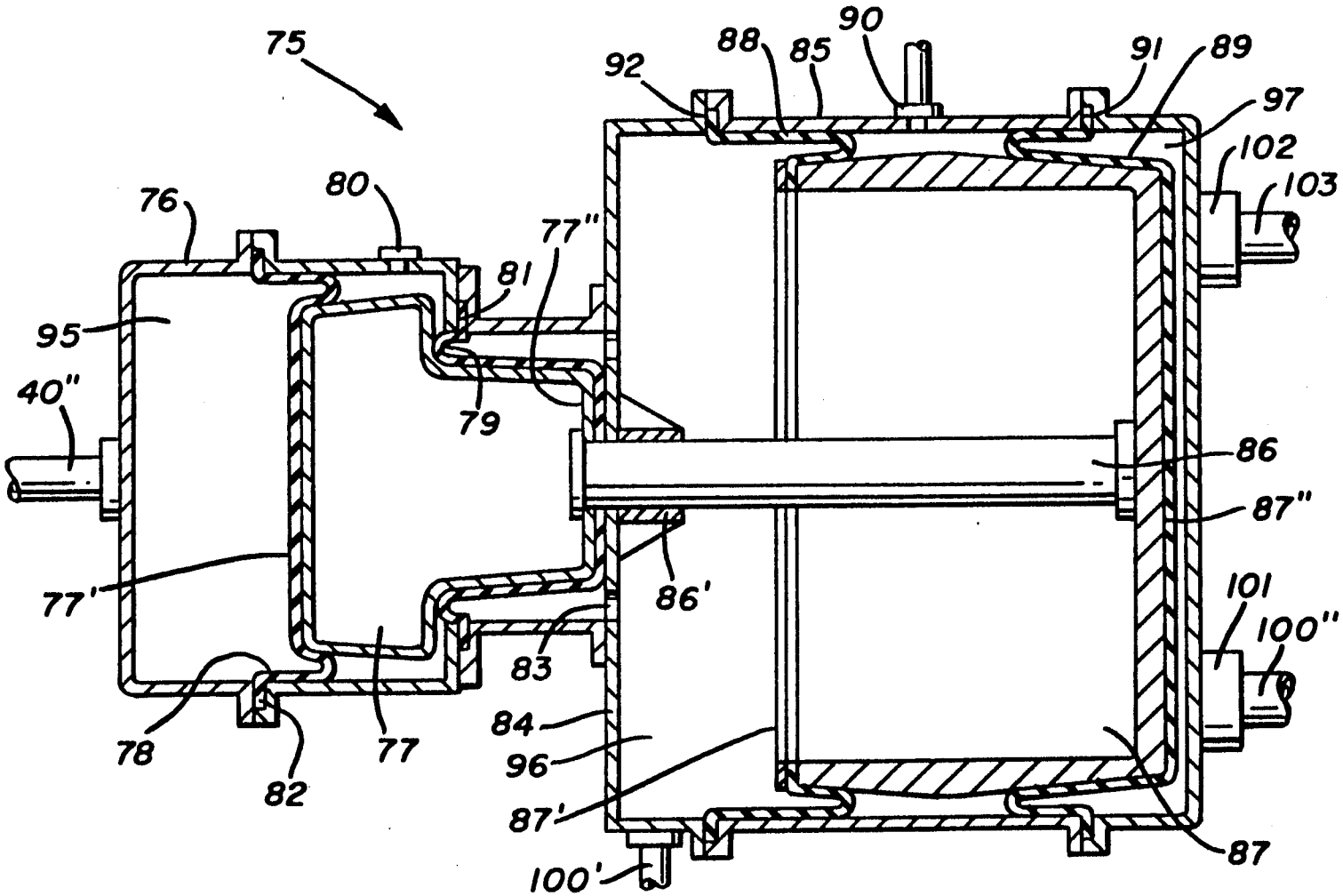
FIG. 3 is an enlarged partially schematic cross-sectional view of the compressor of the compressor section of the heat pump system of FIG. 1.

As best seen in FIG. 3 of the drawings, the branch hydraulic line 40" enters a reduced diameter housing 76 of the compressor 75. The reduced diameter housing 76 encloses a hydraulic piston 77 which is axially movable therein. The piston 77 is preferably interrelated with the housing 76 by a hydraulic diaphragm 78 attached proximate a radial face 77' of piston 77 facing branch hydraulic line 40". The piston 77 is also interrelated with the housing 76 by a return stroke diaphragm 79 which is attached to piston 77 proximate radial face 77" at the extremity opposite the hydraulic diaphragm 78. A vacuum fitting 80 may advantageously be positioned in the housing 76 at a position interposed between the attachment point 81 of return stroke diaphragm 79 to housing 76 and attachment point 82 of hydraulic diaphragm 78 to housing 76. The vacuum fitting 80 maintains a vacuum condition in the space defined by the hydraulic diaphragm 78, return stroke diaphragm 79, housing 76 and piston 77. This configuration serves to reduce scuffing of the diaphragms 78, 79 which would be occasioned by the presence of pressure on both sides of these rolling diaphragm elements, such that the service life of diaphragms 78, 79 is significantly extended. It is to be noted that piston 77 and housing 76 may be T-shaped in axial cross section in order that radial faces 77', 77" of piston 77 have appropriate surface areas to effect the operation hereinafter described.

In axial proximity to the reduced diameter housing 76 in a direction opposite the branch hydraulic line 40" there is an enlarged diameter housing 85 which communicates with housing 76 by virtue of apertures 83 in radial wall 84 of the housing 85. The enlarged diameter housing 85 has a compressor piston 87 which is axially movable therein. The compressor piston 87 is spaced from and attached to the hydraulic piston 77 by a connecting rod 86 for axial movement therewith. The connecting rod 86 may be radially stabilized and aligned for direct axial movement by a guide 86' in radial wall 84 of the housing 85. The piston 87 is preferably interrelated with the housing 85 by a low pressure diaphragm 88 attached proximate a radial face 87' of piston 87 facing hydraulic piston 77. The piston 87 is also interrelated with the housing 85 by a high pressure diaphragm 89 which is attached to piston 87 proximate a radial face 87" at the extremity opposite the low pressure diaphragm 88. A vacuum fitting 90 may advantageously be positioned in the housing 85 at a position interposed between the attachment point 91 of high pressure diaphragm 89 to housing 85 and attachment point 92 of low pressure diaphragm 88 to housing 85. The vacuum fitting 90 maintains a vacuum condition in the space defined by low pressure diaphragm 88, high pressure diaphragm 89, housing 85 and piston 87, in a manner comparable to the arrangement with hydraulic piston 77. This configuration similarly serves to reduce scuffing of the diaphragms 88, 89 which would be occasioned by the presence of pressure on both sides of these rolling diaphragm elements, such that the service life of diaphragms 88, 89 is significantly extended.

The housings 76 and 85, together with the pistons 77, 87 and their aforedescribed diaphragms form a plurality of compartments in the compressor 75. There is a hydraulic fluid compartment 95 to the left of hydraulic piston 77 bounded by housing 76 and hydraulic diaphragm 78. The ingress and egress of hydraulic fluid to the hydraulic fluid compartment 95 is effected through the branch hydraulic line 40". A low pressure refrigerant compartment 96 is formed between hydraulic piston 77 and compressor piston 87 which is bounded by portions of the housings 76 and 85, the return stroke diaphragm 79, and the low pressure diaphragm 88. A high pressure refrigerant compartment 97 is formed to the right of compressor piston 87, as viewed in FIG. 3, which is bounded by portions of the housing 85 and the high pressure diaphragm 89.

The low pressure refrigerant compartment 96 and the high pressure refrigerant compartment 97 are supplied with the working fluid for the compressor section 12 by a compressor section low pressure gas line 100. The low pressure gas line 100 splits into a branch low pressure gas line 100', which is seen in FIGS. 1 and 3, continually supplying low pressure gas to the low pressure refrigerant compartment 96. The low pressure gas line 100 has a second branch low pressure gas line 100" which provides an intermittent input of low pressure gas to the high pressure refrigerant compartment 97 through a gas inlet check valve 101 in the housing 85. The high pressure refrigerant compartment 97 also has a gas outlet check valve 102 which connects to a compressor section high pressure gas line 103, as seen in FIGS. 1 and 3.

Since the compressor section 12 of heat pump system 10 consists of components which operate as a conventional heat pump system, a suitable working fluid for the compressor section 12 may be a standard R-22 refrigerant. It is to be appreciated, however, that other fluorochloro hydrocarbon compounds or other refrigerants having comparable characteristics could be employed to carry out the operation of compressor section 12 of the instant system, depending upon operating characteristics of various system components.

In operation, the compressor 75 is depicted in FIG. 3 at the conclusion of the power stroke. At the conclusion of the power stroke, the gas inlet check valve 101 opens, and the gas outlet check valve 102 closes. At that time, low pressure gas from branch low pressure gas line 100" is supplied to high pressure refrigerant compartment 97. The same low pressure gas is continually supplied to the low pressure refrigerant compartment 96 through the branch low pressure gas line 100'. Since the pressure to either side of the compressor piston 87 in high pressure refrigerant compartment 97 and low pressure refrigerant compartment 96 are the same, the return stroke of the compressor piston 87 commences due to the surface area differential on which the pressures are operating. In the high pressure refrigerant compartment 97, the force results from the pressure operating on the entire radial face 87" of the compressor piston 87. In the low pressure refrigerant compartment 96, the operating force on the compressor piston 87 is of a reduced magnitude because the opposing force operating on the compressor piston 87 constitutes the force produced by the pressure operating on the radial face 87' of the compressor piston 87, less the force produced by the pressure acting on the radial face 77" of the hydraulic piston 77. The resultant force differential on compressor piston 87 produces return stroke displacement of compressor piston 87 to the left from the position of FIG. 3 of the drawings.

The return stroke displacement of compressor piston 87 is accompanied by displacement to the left, as viewed in FIG. 3 of the drawings, of the hydraulic piston 77 to discharge hydraulic fluid into the branch hydraulic line 40". This return of hydraulic fluid in branch hydraulic line 40" is transmitted to the power unit 25. The power unit 25 is then at the end of the power stroke with the pistons 27, 31 fully displaced to the left and the space to the right side of piston 27 in housing 26 being exhausted into the intermediate housing 30. It will be appreciated that the pistons 77 and 87 need be sized and otherwise designed such as to insure the return stroke of compressor piston 87 with the hydraulic piston 77 imparting sufficient pressure to the hydraulic fluid such that the return stroke of power unit 25 is also assured.

Once the return stroke of pistons 77, 87 is completed, the power unit 25 commences its power stroke as hereinabove described. At that time, the gas inlet check valve 101 closes, and the gas outlet check valve 102 opens. The pressurized hydraulic fluid supplied by power unit 25 entering hydraulic fluid compartment 95 displaces the hydraulic piston 77 to the right and contemporaneously therewith the compressor piston 87. The low pressure refrigerant supplied from the compressor section low pressure gas line 100 to the high pressure refrigerant compartment 97 during the return stroke is compressed and its pressure substantially increased due to the movement of the compressor piston 87 during the power stroke. The compressed refrigerant exits through the gas outlet check valve 102 into compressor section high pressure gas line 103. It is to be noted that branch low pressure gas line 100' continually supplies low pressure refrigerant to the low pressure refrigerant compartment 96 during the power stroke. This pressure in the low pressure refrigerant compartment 96 serves to reduce the pressure required in hydraulic fluid compartment 95 necessary to achieve the output pressure effected at the gas outlet check valve 102. Once the pistons 77, 87 reach the position depicted in FIG. 3 of the drawings, the power stroke of the compressor 75 is completed and the aforedescribed operating cycle is reinstituted.

The high pressure refrigerant exiting compressor 75 into the compressor section high pressure gas line 103 is directed through heat exchanger 66 where it is cooled somewhat by giving up heat to the liquid circulating in high pressure liquid line 65 of power section 11 as described hereinabove. The high pressure gas refrigerant exits heat exchanger 66 in a high pressure reduced temperature gas line 105 which is connected with a four-way valve 106. As previously indicated, the remainder of the compressor section 12 may constitute conventional heat pump components and operations, with the four-way valve 106 providing the flow reversal function of the refrigerant necessary to effect both cooling and heating operation.

In the air conditioning or cooling operating mode, the four-way valve 106 effects connection of high pressure gas line 105 with a condenser gas line 107 which directs the gaseous refrigerant to a standard air conditioning condenser 108. The condenser 108 effects heat removal from the gaseous refrigerant to the ambient air with the refrigerant being converted to a liquid. The liquid exits the condenser 108 through a condenser liquid line 109 which directs the liquid refrigerant through a check valve 110 and through an expansion check valve 111 into evaporator liquid line 112. The evaporator liquid line 112 passes the liquid refrigerant through the evaporator 115 where the liquid refrigerant absorbs heat in air circulated through evaporator 115 from the area to be cooled and changes the refrigerant to a gas. The refrigerant exits evaporator 115 through an evaporator gas line 116 which is connected to four-way valve 106. The valve 106 in the cooling mode connects evaporator gas line 116 with low pressure gas line 100 through which the refrigerant is returned to the compressor 75. A suction accumulator 117 may be installed in the low pressure gas line 100.

In the heating operating mode, the compressor 75 and the heat exchanger 66 operate in the identical manner. The four-way valve 106, in this instance, effects connection of high pressure gas line 105 with the evaporator gas line 116. The refrigerant gas in evaporator gas line 116 is introduced to evaporator 115 where it is condensed, giving up the latent heat of condensation to air from the area to be heated. The refrigerant condensed to a liquid in evaporator 115 exits as a liquid in evaporator liquid line 112 which passes the liquid refrigerant through a check valve 120 and through an expansion check valve 121 into condenser liquid line 109 which directs the liquid refrigerant to the condenser 108. In the condenser 108, the liquid refrigerant from condenser liquid line 109 is converted into gas by absorbing the requisite heat of vaporization from the ambient air and the rejected heat from condenser 51. The gaseous refrigerant formed in condenser 108 is discharged through condenser gas line 107 which is connected to four-way valve 106. The valve 106 in the heating mode connects condenser gas line 107 with low pressure gas line 100 which returns the gaseous refrigerant through the suction accumulator 117 to the compressor 75.

It will be readily appreciated by persons skilled in the art that a unit designed to accomplish only a heating or air conditioning function may eliminate the four-way valve 106, the check valves 110, 120 and expansion check valves 111, 121 and otherwise provide direct interconnection between the other system components.

Figure 4:
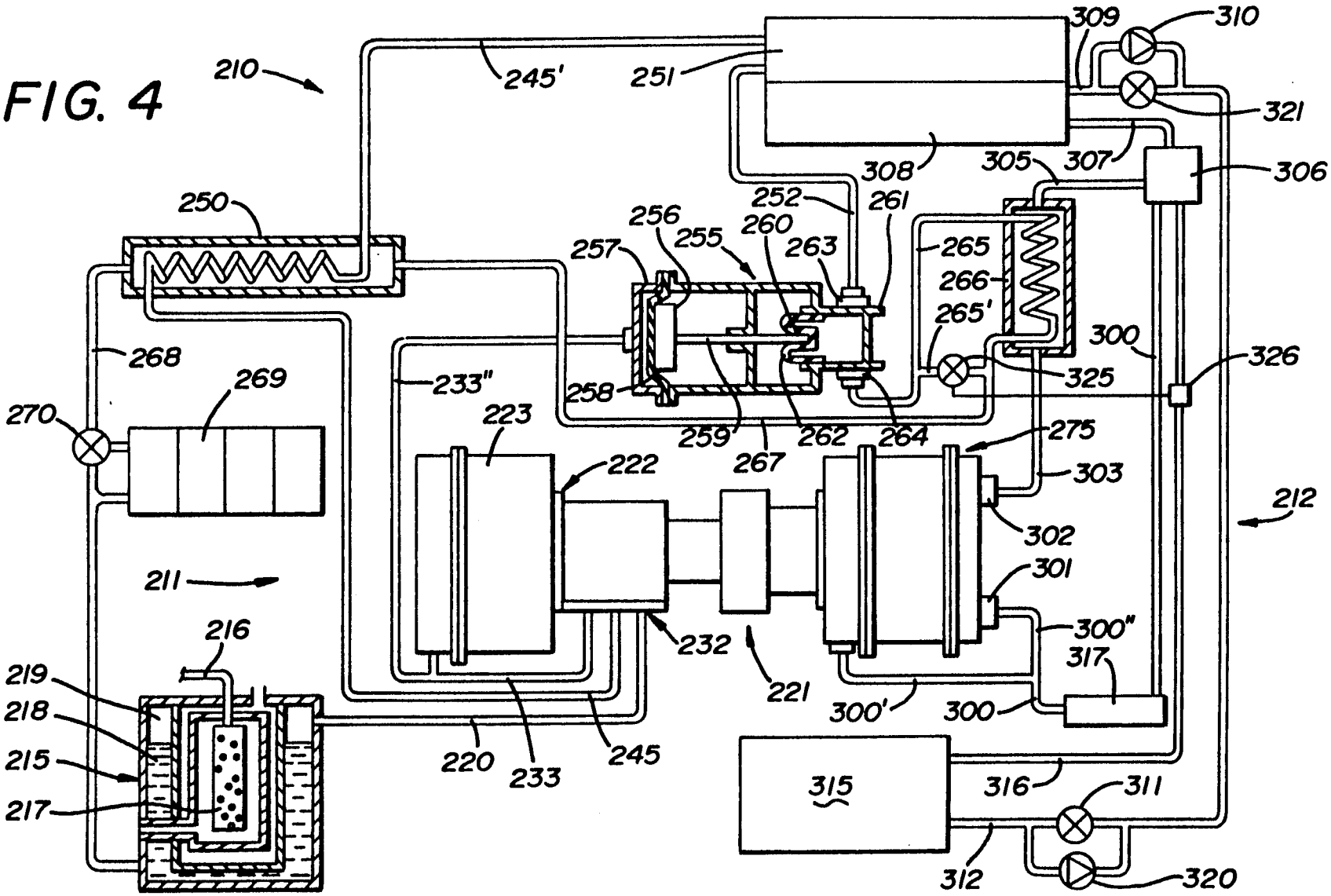
FIG. 4 is a largely schematic depiction of an exemplary heat pump system embodying the concepts of a second embodiment of the present invention with schematic depictions of primary internal operating elements of certain of the components in a manner similar to FIG. 1.

An exemplary heat pump system embodying the concepts of the second embodiment of the present invention is generally denoted by the numeral 210 in FIG. 4 of the accompanying drawings. The heat pump system 210 has a power section, generally indicated by the numeral 211, which drives and otherwise interrelates with a compressor section, generally indicated by the numeral 212. As will be appreciated from the following description, the power section 211 employs a Rankine cycle, and the compressor section 212 employs a vapor compression cycle. The heat pump system 210 is similar to heat pump system 10 in many respects and differs in other respects which are particularly detailed hereinafter.

The power section 211 converts heat supplied to the system 210 to work in the form of pressurized fluid which drives other components of the system. The power section 211 has a conventional generator or evaporator, generally indicated by the numeral 215, which receives a fuel and air mixture through a fuel inlet line 216 which is ignited in a burner 217 to heat a working fluid 218 in the generator 215. While the arrangement shown in FIG. 1 contemplates the usage of a high efficiency gas boiler as the generator 215, it is to be appreciated that other heat sources could be employed, depending on fuel availability and cost, in lieu of the generator 215 to effect heating of liquid working fluid 218 in generator 215 and conversion to a saturated vapor condition in an expansion chamber 219 of the generator 215.

A preferred working fluid for the power section 211 contemplates the use of R-113 refrigerant. It is to be appreciated, however, that other fluoro-chloro hydrocarbon compounds or other refrigerants having comparable characteristics could be employed to carry out the present invention, depending upon operating characteristics of various system components.

The saturated vapor refrigerant is supplied via a power section high pressure gas line 220 to a combined power unit and compressor assembly, generally indicated by the numeral 221. As shown, particularly in FIG. 5, the combined power unit and compressor assembly 221 has a power unit section, generally indicated by the numeral 222 which has an enlarged housing 223 that carries a power piston 224 which is attached to a connecting rod 225. The connecting rod 225 extends through an annular wall 226 of housing 223 into an intermediate housing 227 where it is attached to a drive piston 228 which extends into a reduced diameter housing 229. Both the power piston 224 and the drive piston 228 are provided with rolling diaphragms 230 and 231, respectively, which are attached to the pistons 224, 228 and internally of the housings 223 and 229.

Figure 5:
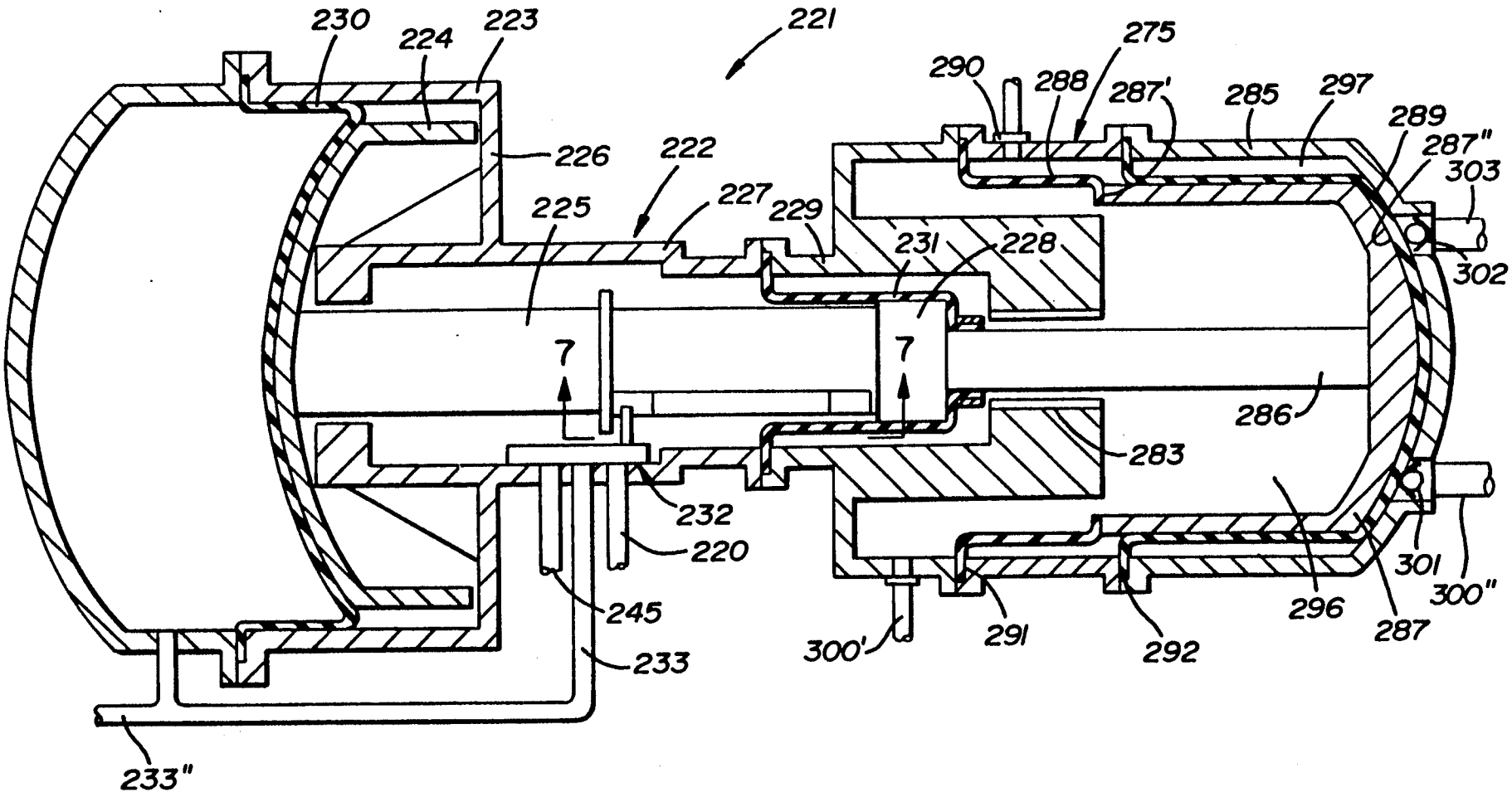
FIG. 5 is an enlarged partially schematic cross-sectional view of a combined drive and compressor assembly of FIG. 4.

The saturated vapor from generator 215 which is transported in power section high pressure gas line 220 is introduced into the power unit section 222 of the combined power unit and compressor assembly 221 via a valve assembly, generally indicated by the numeral 232. Referring particularly to FIG. 5 of the drawings, the valve assembly 232 communicates with the chamber in enlarged housing 223 to the left of power piston 224 and diaphragm 230 by way of an interconnect conduit 233. The valve assembly 232 also interconnects with a power section low pressure gas line 245. In operation, the valve 232 alternately connects the interconnect conduit 233 with the high pressure gas line 220 and the lower pressure gas line 245. As will be appreciated from the discussion of the first embodiment of the invention, the connection of the high pressure gas line 220 with the interconnect conduit 233 will operate to drive the power piston 224 to the right from the position as viewed in FIG. 5, thereby effecting displacement of the connecting rod 225 and the drive piston 228 similarly to the right during the power stroke. The subsequent interconnection of the lower pressure gas line 245 with interconnect conduit 233 reduces pressure in the chamber in enlarged housing 223 to the left of power piston 224 and diaphragm 230 to effect the exhausting of the chamber during the return stroke of power piston 224.

Figure 6:
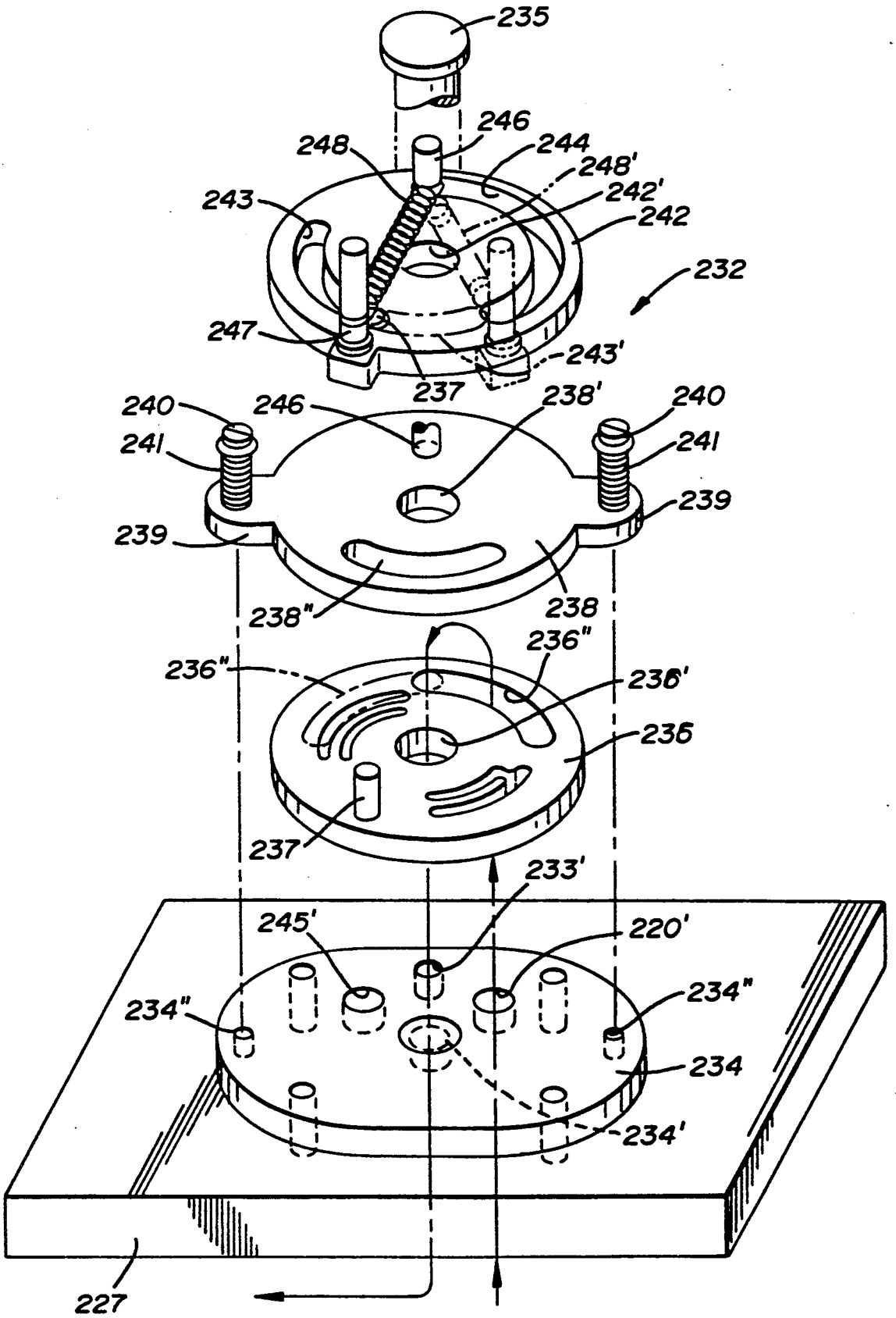
FIG. 6 is an enlarged, exploded view of a valve controlling the ingress and egress of fluids to the power piston as a function of location of the power piston and connecting rod therefor.

The valve assembly 232, as seen in FIGS. 5 and 6, is preferably located interiorly of the intermediate housing 227 for proximity to the connecting rod 225 for a reason hereafter detailed and for purposes of locating it internally of a system component. With this internal arrangement, any inadvertent leak of a working fluid such as R-113 refrigerant from valve 232 does not result in escape of the working fluid to the atmosphere.

Referring now to FIGS. 5 and 6 of the drawings, the valve assembly 232 depicted is of a sandwich type consisting of a plurality of layered plates (see FIG. 6). Initially, a stationary distributor plate 234 is attached to the intermediate housing 227 and has a high pressure gas aperture 220' constituting the termination of high pressure gas line 220, an interconnect conduit aperture 233' constituting the termination of interconnect conduit 233 and low pressure gas aperture 245', constituting the termination of low pressure gas line 245. As shown, the apertures 220', 233' and 245' are positioned on a circle centered on a bore 234' in stationary distributor plate 234 in which a pivot pin 235 is positioned. The stationary distributor plate 234 also has two spaced bores 234'' proximate the ends of its elongate dimension for a purpose hereinafter described.

Reposing atop the stationary distributor plate 234, as seen in FIG. 6, is a moving valve element 236. The valve element 236 is preferably circular and has a central bore 236' through which the pivot pin 235 extends. The valve element 236 is thus rotatable about pivot pin 235 for purposes of moving from the power stroke position to the exhaust position. The valve element 236 also has an elongate slot 236'' consisting of a segment of a circular arc centered about the pivot pin 235. In the position depicted in FIG. 6 in solid lines, the slot 236'' is depicted in the power stroke position with slot 236'' overlying and providing communication between the high pressure gas aperture 220' and the interconnect conduit aperture 233'. In a manner to be described hereinafter, the valve element 236 is rotated about pivot pin 235 to the chain line position wherein the slot 236'' effects interconnection between the interconnect conduit aperture 233' and the low pressure gas aperture 245' during the exhaust stroke of the power piston 224. The rotation of valve element 236 between the two positions of slot 236'' depicted in FIG. 6 is effected by a valve rotation pin 237 which is rigidly attached to and extends upwardly from valve element 236 at a position preferably substantially circumferentially displaced from slot 236''.

Reposing atop the valve element 236 is a stationary holding plate 238 which encloses the valve element 236 between it and the stationary distributor plate 234. Stationary holding plate 238 is preferably substantially circular and has a central bore 238' through which pivot pin 235 extends such that the pivot pin 235 is supported above and below the valve element 236 by fixed elements. The stationary holding plate 238 has a arcuate slot 238'' which serves as a stop for valve rotation pin 237 at the lateral extremities thereof when valve element 236 is positioned in the power stroke and exhaust positions. In the power stroke position of FIG. 6, valve rotation pin 237 would engage the left hand arcuate extremity of slot 238''. In the exhaust position of valve element 236, the valve rotation pin 237 would be rotated clockwise through an extent such as to place valve rotation pin 237 at the right hand arcuate extremity of slot 238'' of stationary holding plate 238.

The stationary holding plate 238 has a pair of projecting ears 239, each of which carries a threaded fastener 240 which is threaded into the bores 234'' of stationary distributor plate 234. As can be seen in FIG. 6, the ears 239 are displaced a distance radially outwardly of the pin 235 in stationary holding plate 238 such that they do not engage the valve element 236. Interposed between each of the ears 239 and the heads of each of fasteners 240 are compression springs 241. Upon tightening of the fasteners 240, compression springs 241 urge stationary holding plate 238 into pressure engagement with valve element 236 which similarly is in pressure engagement with stationary distributor plate 234.

The valve element 236 is preferably constructed of a ceramic material such as alumina silicate or other material having a sufficiently smooth surface such as to prevent fluid leakage between valve element 236 and plates 234 and 238 upon the application of suitable clamping pressure by fasteners 240 and compression springs 241. The plates 234, 238 are advantageously constructed of ceramic plastic to effect the requisite sealing engagement with valve element 236 such as to provide a fluid-tight valve assembly 232 which does not possess conventional sealing elements that could experience deleterious wear over extended operating periods.

The valve assembly 232 has at the top thereof as viewed in FIG. 6 a movable valve switching plate 242. The valve switching plate 242 has a center bore 242' through which pivot pin 235 extends to provide a central pivot for plate 242 and to maintain it in proximity to the stationary holding plate 238. The valve switching plate 242 has a pin actuating slot 243 into which the valve rotation pin 237 extends. The valve switching plate 242 also has a pin clearance slot 244 through which a fixed spring mounting post 246 extends that is attached to the underlying stationary holding plate 238. Valve switching plate 242 has a projecting valve switching pin 247 extending axially upwardly of valve assembly 232. The fixed spring mounting post 246 and the valve switching pin 247 are joined by a tension spring 248.

In moving from the exhaust position of components of valve assembly 232 to the power stroke position, the valve switching pin 247 is displaced to the right from the position depicted in FIG. 6. During the initial movement of valve switching pin 247 and the resultant rotation of valve switching plate 242 in a counterclockwise direction, the valve rotation pin 237 remains stationary and moves in the pin actuating slot 243 to the position 243' depicted in chain lines in FIG. 6. During this movement, the spring 248 is tensioned and becomes positioned in the chain line position 248' to the other side of pivot pin 235 from the original position depicted in solid lines in FIG. 6. The trailing extremity of pin actuating slot 243 then engages the valve rotation pin 237 and displaces it counterclockwise with a rapid snapping action such that pin 237 is displaced from the left hand extremity of slot 238" in stationary holding plate 238 to the extreme right hand extremity of slot 238". As a result, the elongate slot 236" of valve element 236 is displaced from the solid line position to the chain line position of FIG. 6. This spring actuated switching of valve element 236 insures positive transition of valve assembly 232 from the power stroke position to the exhaust position and vice versa. It is significant that the movement of valve element 236 be quickly and positively effected to obviate the possibility of repeated bleeding of high pressure gas to the low pressure gas line without effecting switching of valve assembly 232 from the power stroke position to the exhaust position. The spring 248 during tensioning movement from the solid line position depicted in FIG. 6 necessitates a sufficient build-up of high pressure such as to effect displacement of power piston 224 as described hereinafter.

Figure 7:
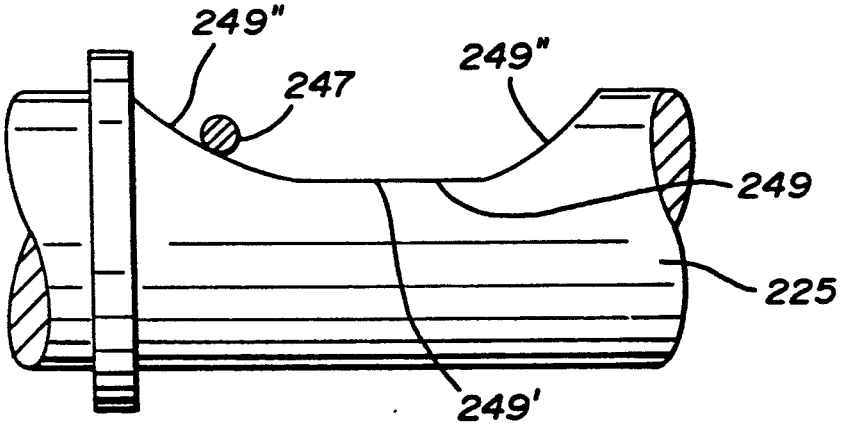
FIG. 7 is an enlarged fragmentary view taken substantially along lines 7—7 of FIG. 5 and showing details of the interrelation between the valve and the connecting rod for the power piston.

The actuation of valve switching pin 247 is effected by its interengagement with a slot 249 in the connecting rod 225 which is attached to the power piston 224. As best seen in FIG. 7, the slot 249 has an elongate horizontal portion 249' and angled ramps 249" defining each axial extremity of the slot 249. In the FIG. 7 position, the connecting rod 225 and power piston 224 would be displaced a distance to the left from but moving toward the position depicted in FIG. 5, such that the valve switching pin 247 has moved into engagement with the left hand ramp 249" preparatory to effecting movement of valve switching plate 242 and subsequent movement of valve element 236 as hereinabove described. The right hand ramp 249" seen in FIG. 7 would operate to return the valve switching pin 247 from right to left, as seen in FIG. 6, during the exhaust stroke and the shifting of valve element 236 from the exhaust position to the power stroke position.

Referring again to FIG. 4 of the drawings, the lower pressure gas in power section low pressure gas line 245 is directed to a heat exchanger 250 where the temperature of the low pressure gas in low pressure gas line 245 is slightly reduced, with the other fluid passing through heat exchanger 250 being heated a comparable amount as set forth hereinafter. A reduced temperature power section low pressure gas line 245 connects the outlet of heat exchanger 250 with a condenser 251. The condenser 251 may be a conventional air conditioning condenser, wherein ambient air is blown over the surface of coils containing the reduced temperature low pressure gas to convert the gas into a liquid. The liquid exits condenser 251 through a low pressure liquid line 252 which is connected to a condensate pump, generally indicated by the numeral 255.

The condensate pump 255 is powered by fluid in a branch interconnect line 233" of interconnect conduit 233 which exits the valve assembly 232 as hereinabove described. The condensate pump 255 may be a relatively simple structural configuration wherein a power piston 256 connected to housing 257 by a rolling diaphragm 258 is joined to a connecting rod 259 which also carries a piston 260 operating in reduced diameter housing 261. The piston 260 may also have a rolling diaphragm 262 connecting it to housing 261. During the power stroke of power unit 222, the power piston 256 of condensate pump 255 is displaced to the right from the position shown in FIG. 4, with the piston 260 being simultaneously displaced to the right in FIG. 4 within the housing 261. The low pressure liquid line 252 communicates interiorly of housing 261 through an inlet check valve 263. An outlet check valve 264 is also positioned in housing 261 and connects with a high pressure liquid line 265. It will, thus, be appreciated that during the power stroke of pistons 256 and 260 to the right from the position depicted in FIG. 4, the inlet check valve 263 will be closed and outlet check valve 264 will be open to permit the flow of pressurized fluid into the high pressure liquid line 265. The return stroke of the pistons 256, 260 to the left as depicted in FIG. 4 is accompanied by a reversal of operating positions of the valves 263, 264, such that the outlet check valve 264 will be closed and the inlet check valve 263 will be open to allow liquid from the low pressure liquid line 252 to enter housing 261 attendant return of the pistons 256, 260 to the position depicted in FIG. 4 during the return or exhaust stroke of pistons 224, 228 of the power unit 222 when the fluid in branch interconnect line 233" is not pressurized, thus readying the condensate pump 255 for a further power stroke.

The high pressure liquid line 265 output from the condensate pump 255 is circulated to a heat exchanger 266 which is interconnected with a line in the compressor section 212 as is described hereinafter. The liquid in high pressure liquid line 265 undergoes a heat gain in passing through heat exchanger 266 with a commensurate heat loss in the compressor section 212. A higher temperature high pressure liquid line 267 outlets from the heat exchanger 266, and the liquid is further circulated to the heat exchanger 250 described hereinabove. As previously indicated, with the fluid in low pressure gas line 245 losing heat in the heat exchanger 250, the liquid in high pressure liquid line 267 gains heat and exits from the heat exchanger 250 into a liquid return line 268. It will, thus, be appreciated that the heat exchangers 266 and 250 operate to raise the temperature of the liquid condensate from condenser 251 preparatory to reintroduction into the generator 215 via liquid return line 268. It will further be appreciated that these incremental temperature increases improve the efficiency of the system 210 in that a lesser temperature increase need be imparted for the liquid to gas change of state in generator 215.

Depending upon the operational requirements of a particular heat pump system 210, the geographic location and other considerations, the liquid condensate in condensate return line 268 may be further heated prior to introduction into the generator 215 to reduce the fuel consumption of the burner 217 in converting the liquid condensate 218 in generator 215 to a gaseous state in expansion chamber 219. To this end, a solar collector 269 constituted of one or more arrays having suitable interconnecting pipes might be interposed in condensate return line 268 as seen in FIG. 4 of the drawings. A conventional two-way valve 270 may be positioned in return line 268 to direct condensate to solar collector 269 during advantageous solar operating conditions and to bypass solar collector 269 under less than advantageous solar operating conditions. Also, supplemental heating might be supplied as a byproduct of a manufacturing process if heat pump system 210 were to be installed in a manufacturing facility.

The compressor section 212 of heat pump system 210 is driven by the power unit section 222 of the combined power unit and compressor assembly 221. As seen in FIG. 5, the power unit section 222 drives a compressor, generally indicated by the numeral 275, of the combined power unit and compressor assembly 221.

In axial proximity to the reduced diameter housing 229 of power unit section 222 in a direction opposite the power piston 224 there is an enlarged diameter compressor housing 285 which communicates with housing 229 radially inwardly of a radial guide 283 formed in the housing 285. The enlarged diameter compressor housing 285 has a compressor piston 287 which is axially movable therein. The compressor piston 287 is spaced from and attached to the drive piston 228 of the power unit section 222 by a connecting rod 286 for axial movement therewith. The connecting rod 286 and compressor piston 287 are proximate to but spaced radially inwardly and outwardly of guide 283 in the housing 285. The compressor piston 287 is preferably interrelated with the housing 285 by a low pressure diaphragm 288 attached proximate a radial face 287′ of piston 287 facing drive piston 228. The piston 287 is also interrelated with the housing 285 by a high pressure diaphragm 289 which is attached to piston 287 proximate a radial face 287″ at the extremity opposite the low pressure diaphragm 288. A vacuum fitting 290 may advantageously be positioned in the housing 285 at a position interposed between the attachment point 291 of high pressure diaphragm 289 to housing 285 and attachment point 292 of low pressure diaphragm 288 to housing 285. The vacuum fitting 290 maintains a vacuum condition in the space defined by low pressure diaphragm 288, high pressure diaphragm 289, housing 285 and piston 287. This configuration serves to reduce scuffing of the diaphragms 288, 289 which would be occasioned by the presence of pressure on both sides of these rolling diaphragm elements, such that the service life of diaphragms 288, 289 is significantly extended.

The housing 229 and 285, together with the pistons 228, 287 and their aforedescribed diaphragms form a plurality of compartments in the compressor 275. A low pressure refrigerant compartment 296 is formed between drive piston 228 and compressor piston 287 which is bounded by portions of the housings 229 and 285, the drive piston diaphragm 231, and the low pressure diaphragm 288. A high pressure refrigerant compartment 297 is formed to the right of compressor piston 287, as viewed in FIG. 3, which is bounded by portions of the housing 285 and the high pressure diaphragm 289.

The low pressure refrigerant compartment 296 and the high pressure refrigerant compartment 297 are supplied with the working fluid for the compressor section 212 by a compressor section low pressure gas line 300 (FIG. 4). The low pressure gas line 300 splits into a branch low pressure gas line 300′, which is seen in FIGS. 4 and 5, continually supplying low pressure gas to the low pressure refrigerant compartment 296. The low pressure gas line 300 has a second branch low pressure gas line 300″ which provides an intermittent input of low pressure gas to the high pressure refrigerant compartment 297 through a gas inlet check valve 301 in the housing 285. The high pressure refrigerant compartment 297 also has a gas outlet check valve 302 which connects to a compressor section high pressure gas line 303, as seen in FIGS. 4 and 5. Since the compressor section 212 of heat pump system 210 consists of components which operate as a conventional heat pump system, a suitable working fluid for the compressor section 212 may be a standard R-22 refrigerant. It is to be appreciated, however, that other fluoro-chloro hydrocarbon compounds or other refrigerants having comparable characteristics could be employed to carry out the operation of compressor section 212 of the instant system, depending upon operating characteristics of various system components.

In operation, the compressor 275 is depicted in FIG. 5 at the conclusion of the power stroke. At the conclusion of the power stroke, the gas inlet check valve 301 opens, and the gas outlet check valve 302 closes. At that time, low pressure gas from branch low pressure gas line 300″ is supplied to high pressure refrigerant compartment 297. The same low pressure gas is continually supplied to the low pressure refrigerant compartment 296 through the branch low pressure gas line 300′. Since the pressure to either side of the compressor piston 287 in high pressure refrigerant compartment 297 and low pressure refrigerant compartment 296 are the same, the return stroke of the compressor piston 287 commences due to the surface area differential on which the pressures are operating. In the high pressure refrigerant compartment 297, the force results from the pressure operating on the entire radial face 287″ of the compressor piston 287. In the low pressure refrigerant compartment 296, the operating force on the compressor piston 287 is of a reduced magnitude because the opposing force operating on the compressor piston 287 constitutes the force produced by the pressure operating on the radial face 287′ of the compressor piston 287, less the force produced by the pressure acting on the face of the drive piston 228. The resultant force differential on compressor piston 287 produces return stroke displacement of compressor piston 287 to the left from the position of FIG. 5 of the drawings.

The return stroke displacement of compressor piston 287 is accompanied by displacement to the left, as viewed in FIG. 3 of the drawings, of the drive piston 228, as well as power piston 224 which is interconnected by connecting rod 225. This return of power piston 224 drives expanded working fluid from the chamber in enlarged housing 223 to the left of power piston 224 in FIG. 5 through interconnect conduit 233 and valve 232 to lower pressure gas line 245. The power unit section 222 is then at the end of the power stroke with the pistons 224, 228, and 287 fully displaced to the left. It will be appreciated that the pistons 224, 228 and 287 need be sized and otherwise designed such as to insure the return stroke compressor 275 of power unit section 222.

Once the return stroke of pistons 224, 228, and 287 is completed, the power unit section 222 commences its power stroke as hereinabove described. At that time, the gas inlet check valve 301 closes, and the gas outlet check valve 302 opens. The pressurized fluid supplied to power unit section 222 displaces the power piston 224 to the right and contemporaneously therewith the compressor piston 287. The low pressure refrigerant supplied from the compressor section low pressure gas line 300 to the high pressure refrigerant compartment 297 during the return stroke is compressed and its pressure substantially increased due to the movement of the compressor piston 287 during the power stroke. The compressed refrigerant exits through the gas outlet check valve 302 into compressor section high pressure gas line 303. It is to be noted that branch low pressure gas line 300' continually supplies low pressure refrigerant to the low pressure refrigerant compartment 296 during the power stroke. The pressure in the low pressure refrigerant compartment 296 serves to reduce the pressure required in the chamber in enlarged housing 223 to the left of the power piston 224 necessary to achieve the output pressure effected at the gas outlet check valve 302. Once the pistons 224, 287 reach the position depicted in FIG. 5 of the drawings, the power stroke of the compressor 275 is completed, and the aforedescribed operating cycle is reinstituted.

As seen in FIG. 4, the high pressure refrigerant exiting compressor 275 into the compressor section high pressure gas line 303 is directed through heat exchanger 266 where it is cooled somewhat by giving up heat to the liquid circulating in high pressure liquid line 265 of power section 211 as described hereinabove. The high pressure gas refrigerant exits heat exchanger 266 in a high pressure reduced temperature gas line 305 which is connected with a four-way valve 306. As previously indicated, the remainder of the compressor section 212 may constitute conventional heat pump components and operations, with the four-way valve 306 providing the flow reversal function of the refrigerant necessary to effect both cooling and heating operation.

In the air conditioning or cooling operating mode, the four-way valve 306 effects connection of high pressure gas line 305 with a condenser gas line 307 which directs the gaseous refrigerant to a standard air conditioning condenser 308. The condenser 308 effects heat removal from the gaseous refrigerant to the ambient air with the refrigerant being converted to a liquid. The liquid exits the condenser 308 through a condenser liquid line 309 which direct the liquid refrigerant through a check valve 310 and through an expansion check valve 311 into evaporator liquid line 312. The evaporator liquid line 312 passes the liquid refrigerant through the evaporator 315 where the liquid refrigerant absorbs heat in air circulated through evaporator 315 from the area to be cooled and changes the refrigerant to a gas. The refrigerant exits evaporator 315 through an evaporator gas line 316 which is connected to four-way valve 306. The valve 306 in the cooling mode connects evaporator gas line 316 with low pressure gas line 300 through which the refrigerant is returned to the compressor 275. A suction accumulator 317 may be installed in the low pressure gas line 300.

In the heating operating mode, the compressor 275 and the heat exchanger 266 operate in the identical manner. The four-way valve 306, in this instance, effects connection of high pressure gas line 305 with the evaporator gas line 316. The refrigerant gas in evaporator gas line 316 is introduced to evaporator 315 where it is condensed, giving up the latent heat of condensation to the air from the area to be heated. The refrigerant condensed to a liquid in evaporator 315 exits as a liquid in evaporator liquid line 312 which passes the liquid refrigerant through a check valve 320 and through an expansion check valve 321 into condenser liquid line 309 which directs the liquid refrigerant to the condenser 308. In the condenser 308, the liquid refrigerant from condenser liquid line 309 is converted into gas by absorbing the requisite heat of vaporization from the ambient air and the rejected heat from condenser 251. The gaseous refrigerant formed in condenser 308 is discharged through condenser gas line 307 which is connected to four-way valve 306. The valve 306 in the heating mode connects condenser gas line 307 with low pressure gas line 300 which returns the gaseous refrigerant through the suction accumulator 317 to the compressor 275.

It will be readily appreciated by persons skilled in the art that a unit designed to accomplish only a heating or air conditioning function may eliminate the four-way valve 306, the check valves 310, 320 and expansion check valves 311, 321 and otherwise provide direct interconnection between the other system components. A two-way valve 325 may advantageously be installed in a bypass line 265' for heat exchanger 266. In normal operation, with valve 325 closed and heat exchanger 266 operative, in the air conditioning mode heat extracted from the area to be cooled is advantageously employed to supply energy to assist in driving the power section 211. In the heating mode under conditions of high demand, it may be desirable not to extract heat from the compressor section 212 by opening valve 325 so that fluid in high pressure liquid line 265 bypasses heat exchanger 266 so as not to reduce the temperature of the fluid in high pressure gas line 303. To this end, a heat sensor switch 326 in evaporator gas line 316 may be employed to open valve 325 when temperature of the fluid in gas line 316 is below a preset value.

An alternate valve assembly, generally indicated by the numeral 332, is shown in FIGS. 8–11 of the drawings. As shown, the alternate valve assembly 332 is incorporated into structure comparable to that shown in the second embodiment of the invention in lieu of the valve assembly 232. In particular, there is a combined power unit and compressor assembly 221' which is similar to the combined power unit and compressor assembly 221 as depicted particularly in FIG. 5 of the drawings.

Figure 8:
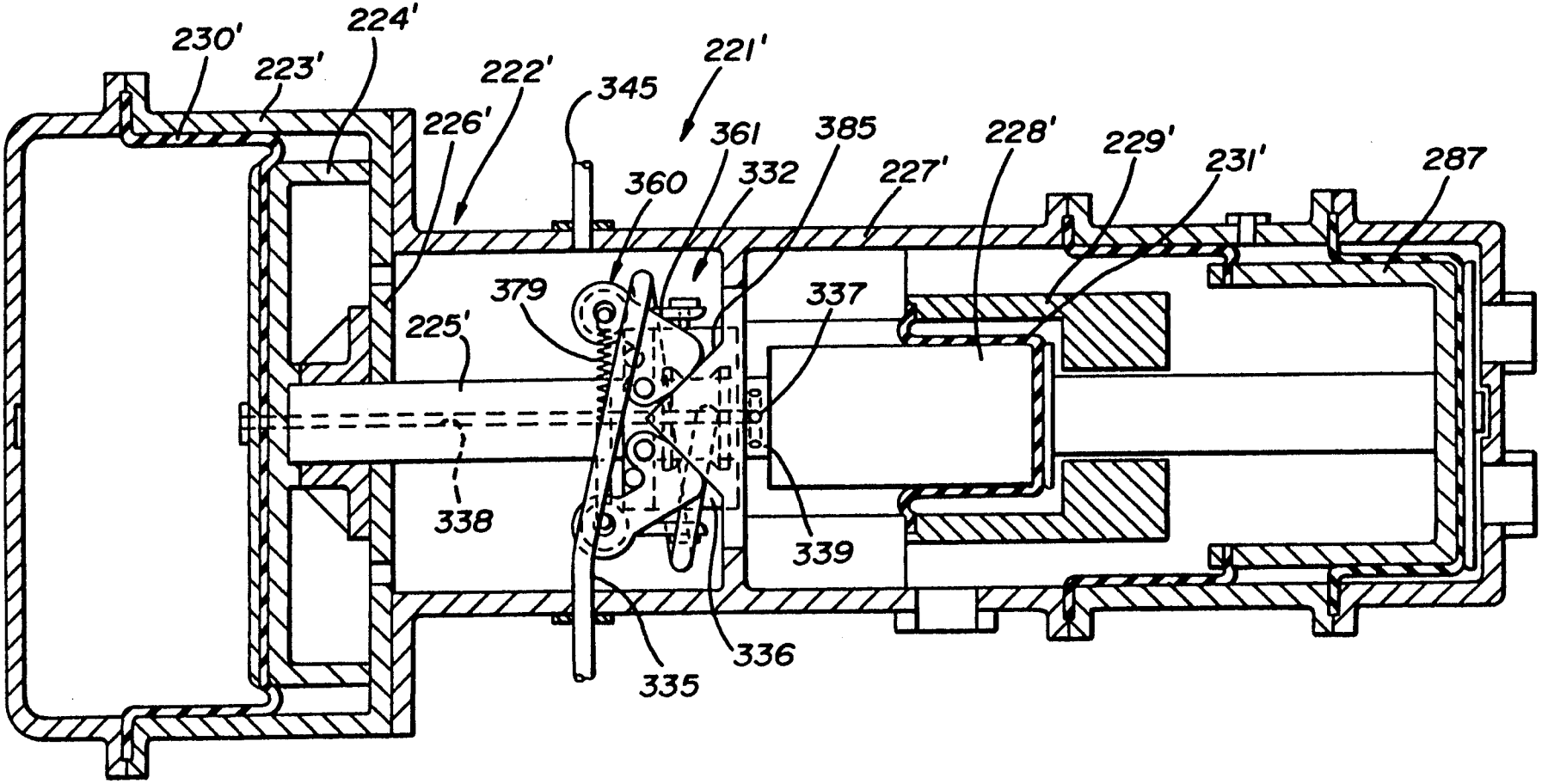
FIG. 8 is a partially schematic fragmentary cross-sectional view of an alternate valve assembly incorporated in the combined drive and compressor assembly of the second embodiment of the invention, depicting the valve after the power stroke and at substantially the start of the exhaust stroke.

As shown, particularly in FIG. 8, the combined power unit and compressor assembly 221' has a power unit section, generally indicated by the numeral 222' which has an enlarged housing 223' that carries a power piston 224' which is attached to a connecting rod 225'. The connecting rod 225' extends through an annular wall 226' of housing 223' into an intermediate housing 227', where it is attached to a drive piston 228', which extends into a reduced diameter housing 229'. Both the power piston 224' and the drive piston 228' are provided with rolling diaphragms 230' and 231', respectively, which are attached to pistons 224', 228' and internally of the housings 223' and 229'.

Saturated vapor from a generator as aforedescribed is introduced into the combined power unit and compressor assembly 221' via a flexible gas inlet tube 335 which is connected to a shuttle valve spool 336 mounted on the connecting rod 225'. The high pressure gas is transferred from interiorly of shuttle valve spool 336 through a plurality of radial passageways 337 (see FIG. 8) and an axial passageway 338 in connecting rod 225'. The axial passageway extends the length of connecting rod 225' in intermediate housing 227' and enlarged housing 223' and terminates at its extremity. This high pressure gas drives the power piston 224' to the right from the position depicted in FIG. 10, thereby effecting displacement of connecting rod 225' and drive piston 228' to the right during the power stroke. The valve assembly 332 also interconnects with a power section low pressure gas line 345 which communicates interiorly of the intermediate housing 227'. During the exhaust stroke of power piston 224', the space to the left of power piston 224' is exhausted through axial passageway 338 and radial passages 337 into intermediate housing 227' and thus to the low pressure gas line 345.

Figure 9:
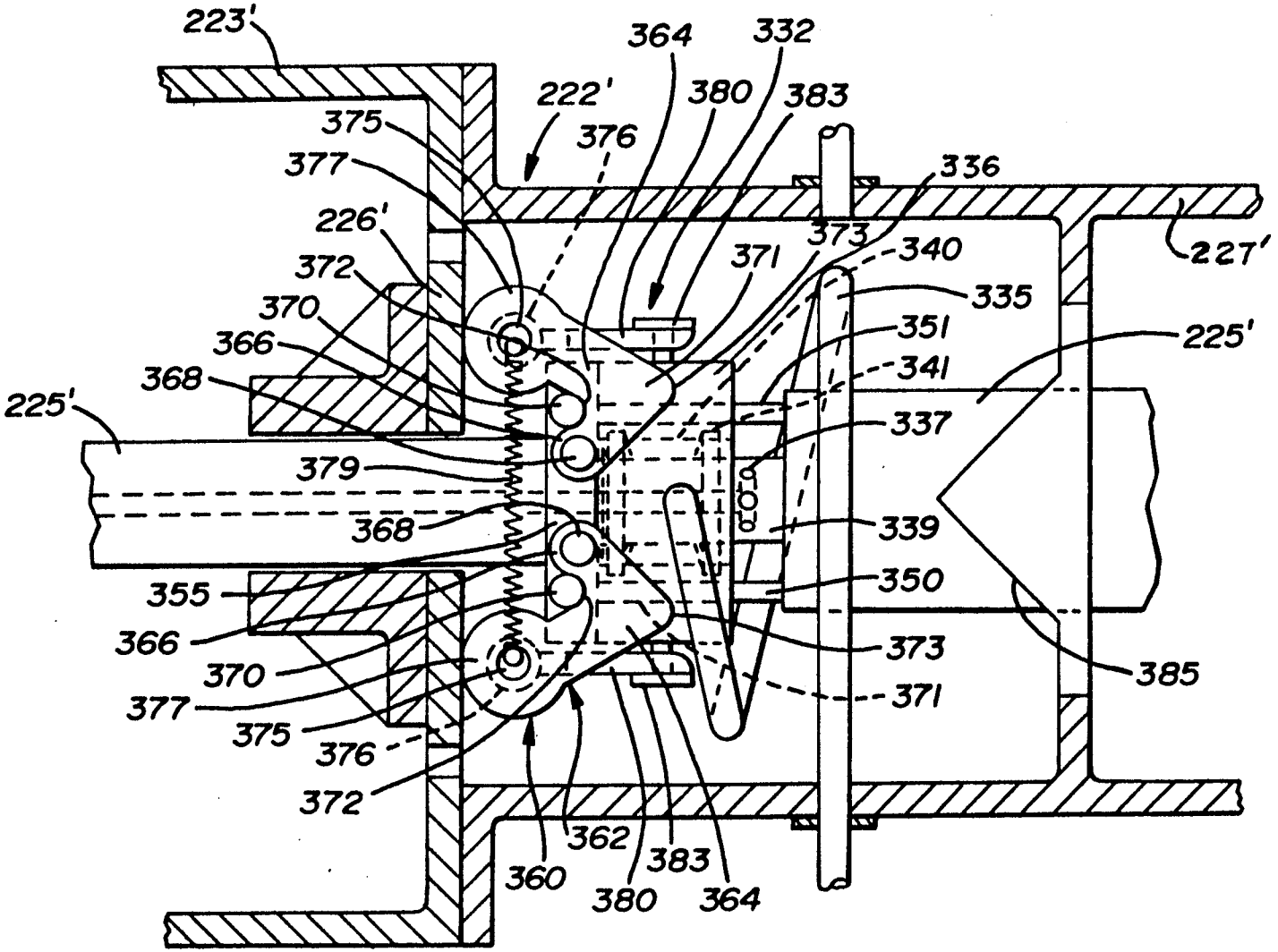
FIG. 9 is an enlarged partially schematic fragmentary cross-sectional view of the alternate valve assembly of FIG. 8 depicting the valve in a position sequential to FIG. 8 at substantially the conclusion of the exhaust stroke.
Figure 10:
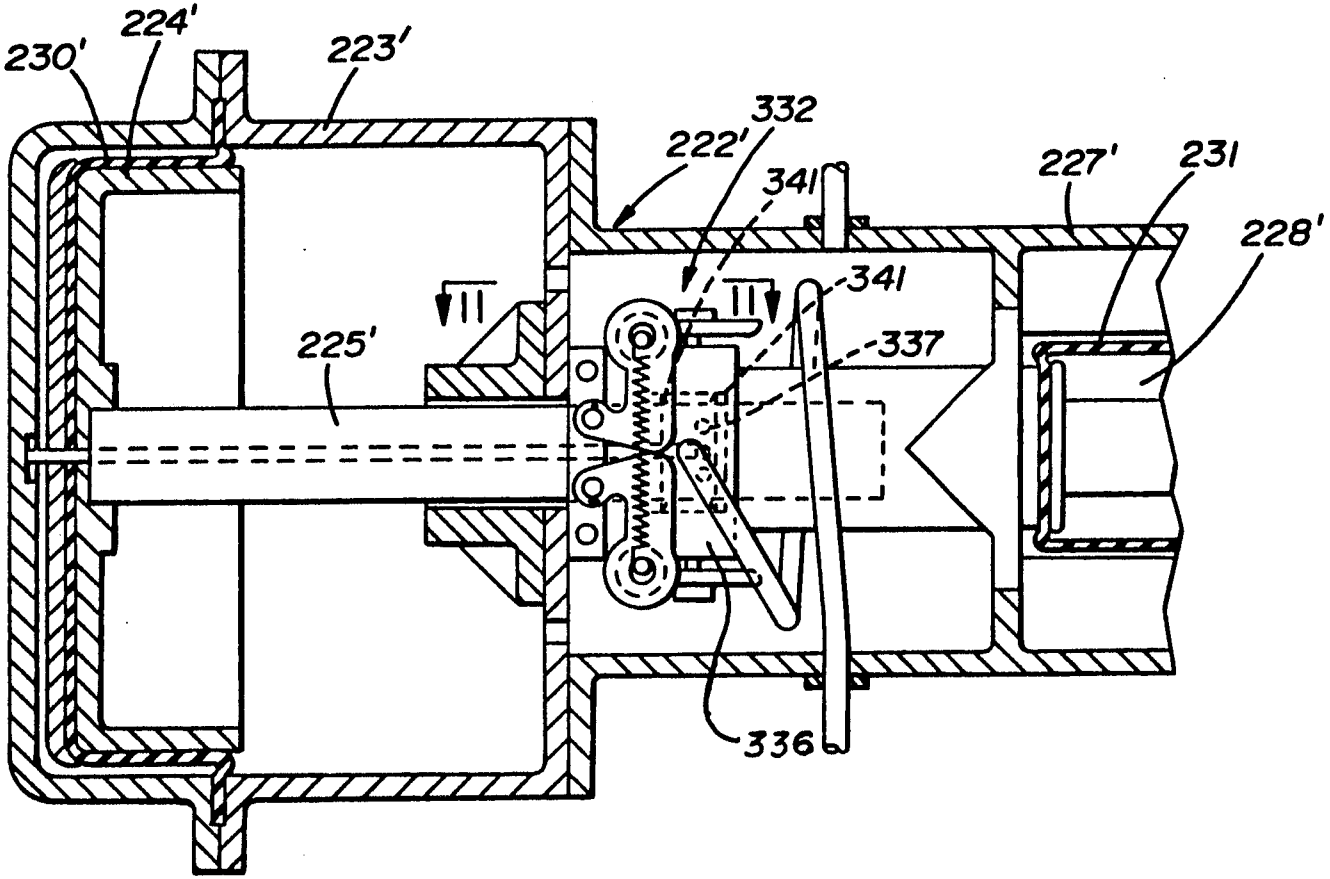
FIG. 10 is a partially schematic fragmentary cross-sectional view of the alternate valve assembly of FIG. 8 depicting the valve in a position sequential to FIG. 10 after the exhaust stroke and at substantially the start of the power stroke.

As seen in FIG. 9, the interconnection of the space to the left of the power piston 224' alternately with the gas inlet tube 335 and the low pressure gas line 345 is effected by selective movement of the shuttle valve spool 336 axially relative to connecting rod 225'. The radial passages 337 are located in a reduced diameter portion 339 of the connecting rod 225'. The shuttle valve spool 336 has an internal bore 340 which is of a diameter slightly greater than the diameter of the reduced diameter portion 339 of connecting rod 225'. The internal bore 340 has seals 341 which may be of a U-cup configuration positioned proximate either axial extremity thereof and engaging reduced diameter portion 339 of connecting rod 225'. It will thus be appreciated that with the shuttle valve spool 336 in position for the commencement of the power stroke as seen in FIG. 10, the radial passageways 337 are interposed between the seals 341 such that high pressure gas introduced interiorly of shuttle valve spool 336 from gas inlet tube 335 passes through radial passages 337 and axial passageway 338 from which it is directed into housing 223' to drive the power piston 224'. It is further to be understood that with the shuttle valve spool 336 in position for commencement of the exhaust stroke as seen in FIG. 8, the shuttle valve spool 336 has moved to the left relative to connecting rod 225' from the power stroke position of FIG. 10, such that the valve spool 336 does not overlie the radial passages 337 and the radial passages 337 are thus not interposed between the seals 341. In this position, the radial passageways 337 communicate with the interior of intermediate housing 227' which communicates with low pressure gas line 345 such as to exhaust the portion of the enlarged housing 223' to the left of power piston 224'.

The shuttle valve spool 336 is mounted on and guided during its movement axially of reduced diameter portion 339 of connecting rod 225' by a pair of guide rods 350, 351, as best seen in FIG. 9. The guide rods 350, 351 extend from the portion of connecting rod 225' to the right of reduced diameter portion 339 to a shuttle arm mounting plate 355, which is rigidly affixed on the connecting rod 225'. The shuttle valve spool 336 is provided with throughbores 352, 352 which receive the guide rods 350, 351 (see FIG. 11). As shown, the guide rods 350, 351 are disposed at diametrically opposed locations relative to the reduced diameter portion 339 of connecting rod 225'. If desired, additional guide rods similar to rods 350, 351 could be provided for mounting the shuttle valve spool 336.

The movement of the shuttle valve spool 336 axially along connecting rod 225' is selectively controlled by a shuttle valve actuating mechanism, generally indicated by the numeral 360. The shuttle valve actuating mechanism 360 is, for the most part, mounted on the shuttle arm mounting plate 355 and effects movement of the shuttle valve spool 336 relative thereto. The shuttle valve actuating mechanism 360 has an upper shuttle arm assembly 361 and a lower shuttle arm assembly 362 which are of essentially identical configuration and operation. Each of upper shuttle arm assembly 361 and lower shuttle arm assembly 362 have a pair of spaced L-shaped arms 364 and 365. The L-shaped arms 364, 365 each have a shoulder 366 having a bore 367 (see FIG. 11) for receiving respective pivot pins 368 which are fixedly mounted on the shuttle arm mounting plate 355. Thus, each of the arms 364, 365 are pivotally mounted relative to the shuttle arm mounting plate 355.

The extent of pivotal movement of arms 364, 365 is limited to a defined arc of movement. On the one hand, the movement of the arms 364, 364 to the left as viewed in FIG. 9 is limited by stop pins 370 which are affixed in the shuttle arm mounting plate 355. As best seen in FIG. 9, the arms 364 have an elbow portion 371 which has an inner circular surface 372 adapted to matingly engage a portion of the exterior surface of the stop pins 370 such that one extent of pivotal movement of arms 364, 365, is as depicted in FIG. 9 of the drawings. The elbow portions 371 of arms 364, 365 have an outer cam surface 373 such that the engagement of cam surfaces 373 of arms 364 and arms 365 of upper shuttle arm assembly 361 and lower shuttle arm assembly 362, defines the extent of pivotal movement of arms 364, 365 to the right as viewed in FIG. 10 of the drawings.

The ends of the L-shaped arms 364, 365 of each of upper shuttle arm assembly 361 and lower shuttle arm assembly 362 opposite the shoulder 366 are interconnected by a shaft 375. Each shaft 375 (see FIG. 9) extends through a bore 376 in a generally cylindrical hub 377 formed at the extremity of each of the arms 364, 365. Preferably proximate both extremities of the shafts 375, 375, there are grooves 378 (see FIG. 11) adapted to receive tension springs 379. Thus, the hubs 377 of arms 364 are joined by one tension spring 379, and the hubs 377 of arms 365 are joined by a second tension spring 379, for a purpose to be hereinafter described.

Interposed between the hubs 377, 377 of arms 364, 365 of upper shuttle arm assembly 361 and lower shuttle arm assembly 362 are drag links 380. Each of the drag links 380 have preferably at one extremity thereof a sleeve 381 (see FIG. 11) which is freely pivotally mounted on shaft 375. The drag links 380 are in the nature of a rectangular link extending from sleeves 381, 381 and have a longitudinal slot 382 extending a substantial portion of the length thereof. The slots 382 receive thrust pins 383 having a shaft of lesser diameter than the width of the slots 382 and a head having a diameter greater than the width of the slots 382 to maintain the drag links 380 positioned on thrust pins 383. The thrust pins 383 are attached to the top and bottom of the shuttle valve spool 336 as best seen in FIG. 9 of the drawings.

The shuttle valve actuating mechanism 360 operates to carry out the positioning of shuttle valve spool 336 to effect the valving functions described above in relation to the operation of the pistons 224', 228' and connecting rod 225' of the combined power unit and compressor assembly 221'. At the commencement of the power stroke as aforedescribed, the shuttle valve actuating mechanism 360 is in the position depicted in FIGS. 10 and 11 of the drawings with the arms 364, 365 at their extent of pivotal movement to the right with the drag link 380 having the left hand extremity (as viewed in FIG. 11) of the longitudinal slot 382 engaging the pin 383 to position shuttle valve spool 336 to the right to overlie the radial passageways 337 which are thus interposed between seals 341. The power stroke effects displacement of the connecting rod 225' to the right until such time as the cam surface 373 of elbow portions 371 of arms 364, 365 engage shifting wedges 385. The shifting wedges 385 may conveniently be affixed at diametrically opposed positions to a radially inwardly directed portion of the intermediate housing 227'. With the shuttle valve spool 336 and shuttle arm mounting plate 355 moving to the right from the FIG. 10 position, the stationary shifting wedges 385 pivot the arms 364, 365 from the extreme right position depicted in FIG. 10 of the drawings to the extreme left position depicted in FIG. 8 of the drawings.

It is to be appreciated that upon initial engagement of the arms 364, 365 by the stationary shifting wedges 385, the springs 379 are initially tensioned until such time as the shafts 375 are in vertical alignment with the pivot pins 368 of the arms 364, 365. Further action by the stationary shifting wedges 385 as the connecting rod 225' moves to the right results in a rapid movement of the arms 364, 365 to the position depicted in FIG. 8 of the drawings. It is to be understood that during the initial movement of arms 364, 365 to their position in vertical alignment with pivot pins 368, the pin 383 moves in the slot 382 such that the shuttle valve spool 336 is not moved. After the arms 364, 365 pass vertical alignment with pivot pins 368, the right side extremity of slot 382 of drag links 380 engages the thrust pins 383 to effect rapid shifting of shuttle valve spool 336 from the right hand position to the left hand position seen in FIG. 8, as assisted by operation of tension springs 379. With the shuttle valve spool 336 thus shifted to the left, the valve assembly 332 is positioned for the exhaust stroke of power piston 224'.

During the exhaust stroke as aforedescribed, the shuttle valve actuating mechanism 360 remains in the position depicted in FIGS. 8 and 9 of the drawings with the arms 364, 365 at their extent of pivotal movement to the left with the drag link 380 having the right hand extremity (as best seen in FIG. 9) of the longitudinal slot 382 engaging the pin 383 to position shuttle valve spool 336 to the left to connect radial passageways 337 with intermediate housing 227' and thus to low pressure gas line 345. The exhaust stroke effects displacement of the connecting rod 225' to the left until such time as the cylindrical hubs 377 of arms 364, 365 engage annular wall 226'. With the shuttle valve spool 336 and shuttle arm mounting plate moving to the left from the FIG. 9 position, the annular wall 226' pivots the arms 364, 365 from the extreme left position depicted in FIG. 9 of the drawings to the extreme right position depicted in FIG. 10 of the drawings.

It is to be appreciated that upon initial engagement of the arms 364, 365 by the annular wall 226', the springs 379 are initially tensioned until such time as the shafts 375 are in vertical alignment with the pivot pins 368 of the arms 364, 365. Further action by the annular wall 226' as the connecting rod 225' moves to the left results in a rapid movement of the arms 364, 365 to the position depicted in FIG. 10 of the drawings. It is to be understood that during the initial movement of arms 364, 365 to their position in vertical alignment with pivot pins 368, the pin 383 moves in the slot 382 such that the shuttle valve spool 336 is not moved. After the arms 364, 365 pass vertical alignment with pivot pins 368, the left side extremity of slot 382 of drag links 380 engages the thrust pins 383 to effect rapid shifting of shuttle valve spool 336 from the left hand position to the right hand position seen in FIG. 10, as assisted by operation of tension springs 379. With the shuttle valve spool 336 thus shifted to the right, the valve assembly 332 is positioned for another power stroke of power piston 224'.

Figure 11:
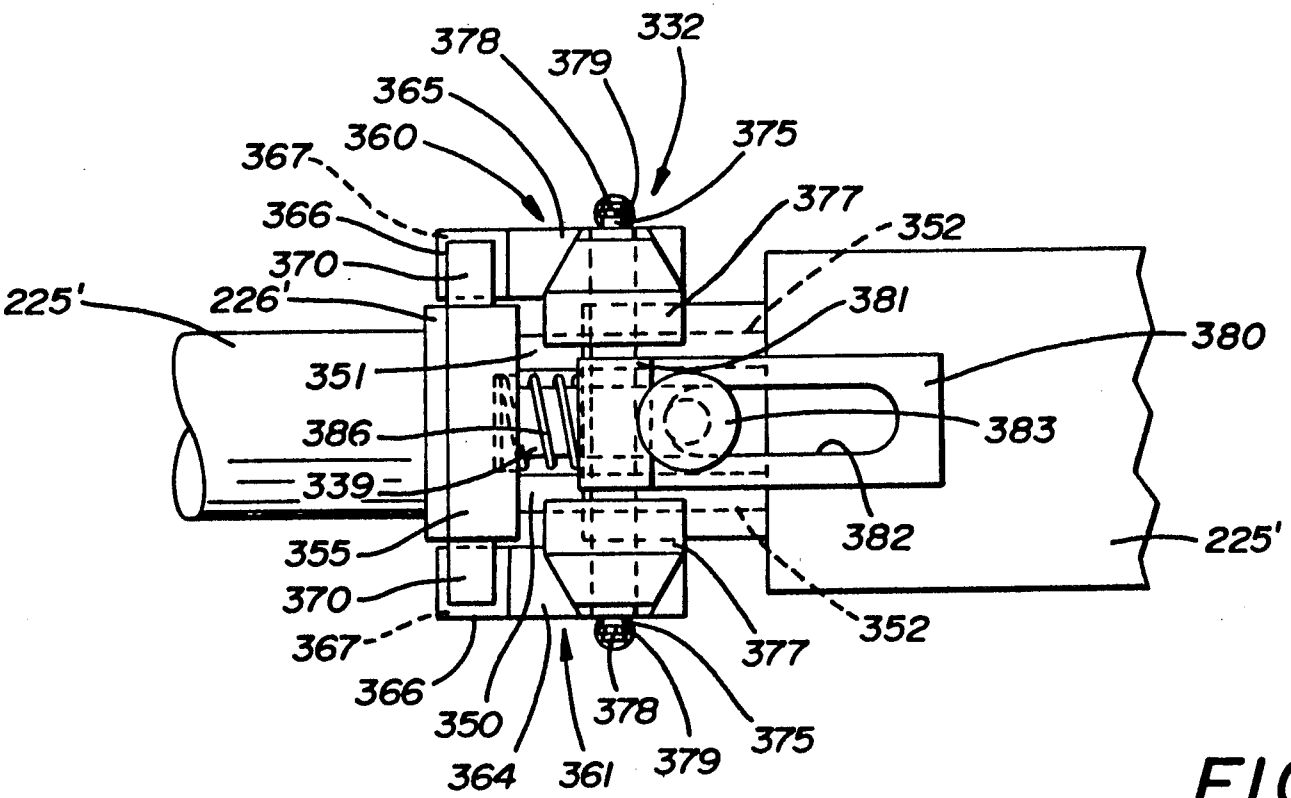
FIG. 11 is an enlarged fragmentary top plan view of the valve assembly of FIG. 8 taken substantially along the line 11—11 of FIG. 10.

If desired, the shifting of shuttle valve spool 336 from the exhaust position to the power stroke position may be assisted by a compression spring 386 (FIG. 11). As shown, the compression spring surrounds the reduced diameter portion 339 of connecting rod 225' and is interposed between the shuttle valve spool 336 and a bore 387 in connecting rod 225'. The spring 386 is compressed at the end of the power stroke of power piston 224' when shuttle valve spool 336 moves from right to left, and there is an abundance of available power. The compressed spring 386 does not impart a force sufficient to move shuttle valve spool 336 to the power stroke position; however, it does assist such movement once instituted by the cylindrical hubs 377 engaging the annular wall 226'. This assisting force supplements the force provided by the return stroke of compressor piston 287 (see FIG. 8) which is normally less than that generated by power piston 224' during its power stroke.

Figure 12:
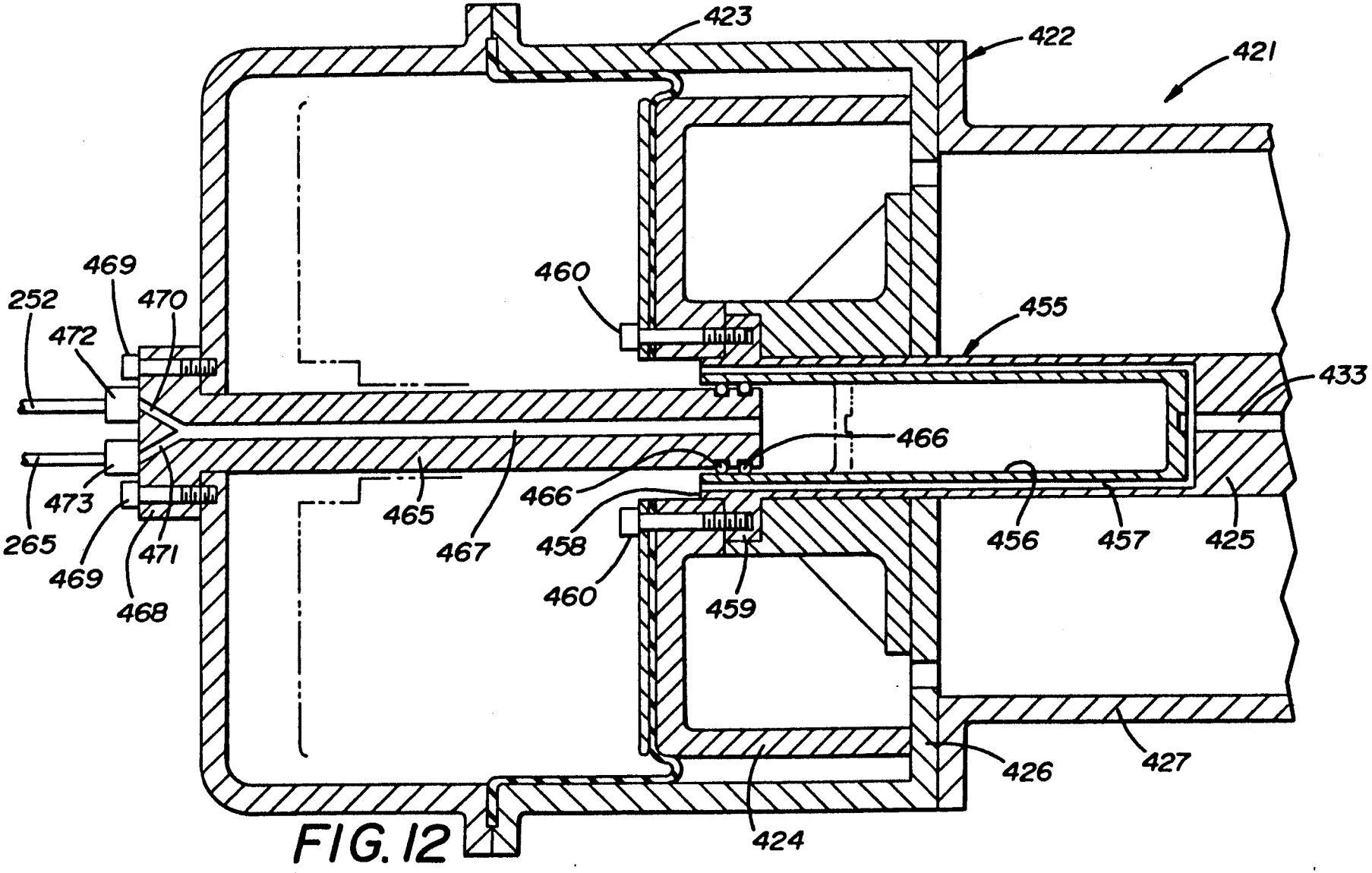
FIG. 12 is an enlarged partially schematic fragmentary cross-sectional view of a combined drive and compressor assembly similar to the second embodiment of the invention with the alternate valve assembly having an alternate condensate pump of the power section incorporated therein.

An alternate condensate pump, generally indicated by the numeral 455 is shown in FIG. 12 of the drawings. As shown, the condensate pump 455 is incorporated into a combined drive and compressor assembly, generally indicated by the numeral 421, which is similar to the combined power unit and compressor assembly 221 described in the second embodiment of the invention with the alternate valve assembly 332 described hereinabove. The combined power unit and compressor assembly 421 has a power unit section, generally indicated by the numeral 422, which has an enlarged housing 423 that carries a power piston 424 which is attached to a connecting rod 425. The connecting rod 425 extends through an annular wall 426 of housing 423 into an intermediate housing 427 where it is attached to a drive piston (not shown) which may be identical to the drive piston 228 described hereinabove.

The connecting rod 425 is axially bored to form a cylinder casing 456 of the condensate pump 455. The connecting rod 425 has an annular duct 457 formed radially outwardly of the cylinder casing 456. The annular duct extends from interconnect conduit 433 to the face 458 of connecting rod 425 in the compartment to the left of power piston 424 in FIG. 12 of the drawings. Thus, the compartment to the left of piston 424 is intermittently connected with a high pressure gas line and a low pressure gas line as described in conjunction with the alternate valve depicted in FIGS. 8-11 of the drawings. The connecting rod 425 is provided with a radially outwardly extending flange 459 which may be attached to the power piston 424 as by fasteners 460 such that the connecting rod 425 and piston 424 move as an integral unit in the manner described in detail hereinabove.

A piston rod 465 extends from the wall of enlarged housing 423 axially displaced from annular wall 426. The piston rod 465 extends a substantial distance into the enlarged housing 423 such that it projects a distance into cylinder casing 456 when power piston 424 is displaced to the extreme right side of enlarged housing 423 as depicted in FIG. 12 of the drawings. The piston rod 465 has one or more piston seals 466 proximate the axial extremity thereof engaging the inner surface of cylinder casing 456. The piston rod 465 has a bore 467 extending substantially the length of piston rod 457 from the axial extremity within cylinder casing 456 to a position proximate the opposite end thereof. The piston rod 465 has an enlarged flange 468 through which fasteners 469 extend to attach piston rod 465 to enlarged housing 423. The bore 467 in piston rod 465 connects with branch bores 470 and 471. The branch bore 470 terminates on the surface of flange 468 of piston rod 465 at an inlet check valve 472. The branch bore 471 terminates on the surface of flange 468 of piston rod 465 at an outlet check valve 473.

It will thus be appreciated that during the return stroke of power piston 424 to the left from the position depicted in FIG. 12 that inlet check valve 472 will be closed and outlet check valve 473 will be open to permit the flow of pressurized fluid from cylinder casing 456 via bore 467 and branch bore 471 into the high pressure liquid line 265, as seen in FIG. 4 of the drawings. During the power stroke of the power piston 424, the inlet check valve 472 will be open and the outlet check valve 473 will be closed such that liquid from condenser 251 (see FIG. 4) supplied through low pressure liquid line 252 enters through branch bore 470 and bore 467 into cylinder casing 456. The condensate pump 455 is thus prepared for repeated cycles as above described. It thus appears that the condensate pump 455 provides a configuration permitting incorporation of a pump into the power unit and compressor condensate pumps 55 and 255 depicted in FIGS. 1 and 4 of the drawings, respectively.

It is evident that the heat pump system disclosed herein carries out the various objects of the invention set forth hereinabove and otherwise constitutes an advantageous contribution to the art. As will be apparent to persons skilled in the art, other modifications can be made to the preferred embodiment disclosed herein without departing from the spirit of the invention, the scope of the invention being limited solely by the scope of the attached claims.

I claim:

1. A heat pump system comprising, power section means having generator means for converting a first working fluid from a liquid to relatively high pressure gas, power unit means providing energy by the conversion of the relatively high pressure gas to relatively low pressure gas to power drive piston means for intermittently delivering a pressurized second working fluid, power section condenser means converting the first working fluid from the relatively low pressure gas to the liquid, a liquid line connecting said power section condenser means and said generator means, and compressor section means intermittently driven by the second working fluid, said compressor section means having a compressor converting relatively low pressure gas third working fluid to relatively high pressure gas third working fluid for circulating the third working fluid through compressor section condenser means and compressor section evaporator means to selectively effect heating and cooling operations.

2. A heat pump system according to claim 1, wherein the liquid is circulated through solar collector means for supplying supplemental heat to the liquid.

3. A heat pump system according to claim 1, wherein said liquid line has a heat exchanger interposed therein for transferring heat from the relatively low pressure gas in a low pressure gas line passing therethrough to the liquid in said liquid line.

4. A heat pump system according to claim 1, wherein the relatively high pressure third working fluid exits said compressor means through a compressor section means high pressure gas line, said compressor section means high pressure gas line having a heat exchanger interposed therein for transferring heat from the relatively high pressure gas in said compression section means high pressure gas line to the liquid in the liquid line of said power section means passing therethrough.

5. A heat pump system according to claim 1, wherein said power section means has condensate pump means interposed in said liquid line.

6. A heat pump system according to claim 5, wherein said condensate pump is intermittently driven by said second working fluid.

7. A heat pump system according to claim 1, wherein said first and third working fluids are refrigerants and said second working fluid is hydraulic oil.

8. A heat pump system according to claim 1, wherein said compressor includes piston means having a power stroke actuated by said second working fluid.

9. A heat pump system according to claim 8, wherein the return stroke of said piston means is effected by compressor section relatively low pressure gas, the return stroke of said piston means effecting the return stroke of said drive piston means of said power section means.

10. A heat pump system according to claim 1, said compressor section means including flow reversal valve means, check valve means, and suction accumulator means.

11. A heat pump system comprising, compressor means for circulating a relatively high pressure gas working fluid, a high pressure gas working fluid line interconnecting a high pressure chamber of said compressor means and elements of a vapor compression cycle system, a low pressure gas working fluid line interconnecting said elements of a vapor compression cycle system and said high pressure chamber of said compressor means, compressor piston means in said compressor means for converting relatively low pressure gas working fluid to relatively high pressure gas working fluid in said high pressure chamber to one side of said compressor piston, a low pressure gas working fluid branch line connecting said low pressure gas working fluid line and a low pressure chamber in said compressor means to the other side of said compressor piston from said high pressure chamber, and power means operating on said compressor piston means in addition to the relatively low pressure gas working fluid from said low pressure working fluid branch line for pressurizing the relatively low pressure gas fluid in said high pressure chamber, said power means operating on said compressor piston means employs intermittently pressurized hydraulic fluid.

12. A heat pump system according to claim 11, wherein said hydraulic fluid intermittently actuates hydraulic piston means which is interconnected with said compressor piston means by connecting rod means.

13. A heat pump system according to claim 12, wherein said low pressure chamber of said compressor is interposed between and operatively communicates with said compressor piston means and said hydraulic piston means.

14. A heat pump system according to claim 13, wherein said compressor means has a hydraulic fluid chamber for said hydraulic fluid positioned to the other side of said hydraulic piston means from said low pressure chamber.

15. A heat pump according to claim 11, wherein said pistons have rolling diaphragms for effecting fluid isolation between said chambers.

16. A heat pump according to claim 15, wherein each of said pistons have a pair of rolling diaphragms with a vacuum chamber therebetween, whereby said rolling diaphragms are subjected to pressurized fluid on only one side thereof.

17. A heat pump system according to claim 11, wherein relatively low pressure gas working fluid is continuously supplied to said low pressure chamber by said low pressure working fluid branch line.

18. A heat pump system according to claim 17, wherein a first check valve in said low pressure gas working fluid line controls the intermittent supply of relatively low pressure gas working fluid to said high pressure chamber, and a second check valve in said relatively high pressure gas working fluid line controls the intermittent supply of relatively high pressure gas working fluid from said high pressure chamber.

19. A heat pump system comprising, power section means having generator means for converting a first working fluid from a liquid to relatively high pressure gas, power unit means providing energy by the conversion of the relatively high pressure gas to relatively low pressure gas to power drive piston means for intermittently delivering a power stroke, power section condenser means converting the first working fluid from the relatively low pressure gas to the liquid, compressor section means intermittently driven by said drive piston means, said compressor section means having a compressor converting relatively low pressure gas second working fluid to relatively high pressure gas second working fluid for circulating the second working fluid through compressor section condenser means and compressor section evaporator means to selectively effect heating and cooling operations, said compressor having compressor piston means interconnected with said drive piston means by connecting rod means.

20. A heat pump system according to claim 19, wherein said power unit means has power piston means driven by the relatively high pressure gas and connecting rod means for interconnecting said power piston means and said drive piston means.

21. A heat pump system comprising, power section means having generator means for converting a first working fluid from a liquid to relatively high pressure gas, power unit means providing energy by the conversion of the relatively high pressure gas to relatively low pressure gas to power drive piston means for intermittently delivering a power stroke, power section condenser means converting the first working fluid from the relatively low pressure gas to the liquid, compressor section means intermittently driven by said drive piston means, said compressor section means having a compressor converting relatively low pressure gas second working fluid to relatively high pressure gas second working fluid for circulating the second working fluid through compressor section condenser means and compressor section evaporator means to selectively effect heating and cooling operations, said compressor having compressor piston means which is fluid interconnected with said drive piston means.

22. A heat pump system according to claim 20, wherein an elongate housing surrounds said power piston means, said drive piston means and said compressor piston means.

23. A heat pump system according to claim 22, including valve means in said housing for supplying relatively high pressure gas to a compartment to one side of said power piston means during the power stroke thereof and for evacuating said compartment of the relatively low pressure gas during the exhaust stroke thereof.

24. A heat pump system according to claim 23, wherein said valve means is actuated by switching pin means engaging ramps of a slot in said connecting rod means.

25. A heat pump system according to claim 24, wherein said valve means includes a plurality of layered plates.

26. A heat pump system according to claim 25, wherein said valve means includes a rotary valve element having a slot for connecting apertures in an adjacent of said layered plates to effect supplying of the relatively high pressure gas to and evacuating of the relatively low pressure gas from said compartment.

27. A heat pump system according to claim 26, wherein said rotary valve element is of a ceramic material having smooth surfaces for sealing engagement with said layered plates.

28. A heat pump system according to claim 26, wherein said rotary valve element is in pressure engagement with a pair of adjacent of said layered plates which are stationary.

29. A heat pump system according to claim 28, wherein said pair of adjacent of said layered plates are joined by fasteners mounting compression springs for effecting sealing engagement between said rotary valve element and said pair of adjacent of said layered plates.

30. A heat pump system according to claim 28, including a valve switching plate having a pin actuating slot which receives a valve rotation pin attached to said rotary valve element.

31. A heat pump system according to claim 30, wherein said valve switching plate is spring biased for rapid actuation of said rotary valve element once said pin actuating slot engages said valve rotation pin during the rotation thereof.

32. A heat pump system according to claim 19, wherein said power unit means has power piston means driven by the relatively high pressure gas, and first connecting rod means interconnects said power piston means and said drive piston means, and said compressor has compressor piston means interconnected with said drive piston means by second connecting rod means, an elongate housing surrounding said power piston means, said drive piston means and said compressor piston means, and including valve means mounted on said connecting rod means for supplying relatively high pressure gas to a compartment to one side of said power piston means during the power stroke thereof and for evacuating said compartment of the relatively low pressure gas during the exhaust stroke thereof.

33. A heat pump system according to claim 32, wherein said valve means is a shuttle valve having a spool which moves axially relative to passage means in said connecting rod means communicating with said compartment for shifting between positions for the power stroke and the exhaust stroke of said power piston.

34. A heat pump system according to claim 33, wherein said axial movement of said spool is actuated by arm assemblies pivotally mounted on an arm mounting plate affixed to said connecting rod means, said arm assemblies mounting drag links for engaging thrust pins attached to said spool.

35. A heat pump system according to claim 34, wherein said drag links have longitudinal slots for movably engaging said thrust pins during a portion of the rotation of said arm assemblies.

36. A heat pump system according to claim 35, including a pair of arm assemblies joined by spring means, said spring means being tensioned during initial pivotal movements of said arm assemblies and effecting rapid actuation of said spool during the portion of the rotation of said arm assemblies when said drag links movably engage said thrust pins.

37. A heat pump system according to claim 36, including stop means associated with said arm assemblies and said arm mounting plate for defining the extent of pivotal movement of said arm assemblies.

38. A heat pump system according to claim 37, wherein said spool is mounted for movement on guide rods and has an internal bore with seals positioned proximate the axial extremities thereof for engaging a reduced diameter portion of said connecting rod means to either side of said passage means.

39. A heat pump system according to claim 38, wherein a flexible inlet tube extends through said housing to said spool for introducing high pressure gas interiorly thereof which is supplied via said passage means to said compartment for the power stroke of said power piston means.

40. A heat pump system according to claim 19, wherein said power section means has condensate pump means for converting low pressure liquid from said power section condenser means to high pressure liquid supplied to said generator means.

41. A heat pump system according to claim 40, wherein said power unit means has power piston means driven by the relatively high pressure gas and connecting rod means for interconnecting said power piston means and said drive piston means, said connecting rod means having bore means forming a cylinder casing of said condensate pump means.

42. A heat pump system according to claim 41, having an annular duct formed radially outwardly of said bore means for establishing communication between a passageway in said connecting rod means and a compartment formed to one side of said power piston means.

43. A heat pump system according to claim 41, wherein an elongate housing surrounds said power piston means and said drive piston means forming a compartment to one side of said power piston means, said compartment having a fixed piston rod extending into said axial bore.

44. A heat pump system according to claim 43, wherein said piston rod has a throughbore communicating between said cylinder casing and check valves for controlling the ingress and egress of liquid to said cylinder casing.

45. A heat pump system according to claim 44, wherein said piston rod has piston seals engaging the inner surface of said cylinder casing.

46. A heat pump system comprising, power section means having generator means for converting a first working fluid from a liquid to relatively high pressure gas, power unit means providing energy by the conversion of the relatively high pressure gas to relatively low pressure gas to power drive piston means for intermittently delivering a power stroke, power section condenser means converting the first working fluid from the relatively low pressure gas to the liquid, compressor section means intermittently driven by said drive piston means, said compressor section means having a compressor converting relatively low pressure gas second working fluid to relatively high pressure gas second working fluid for circulating the second working fluid through compressor section condenser means and compressor section evaporator means to selectively effecting heating and cooling operations, said relatively high pressure second working fluid exiting said compressor through a compressor section high pressure gas line to a heat exchanger interposed therein for transferring heat from said second working fluid to said first working fluid in a liquid line of said power section passing through said heat exchanger and joining said condenser means and said generator means.

47. A heat pump system according to claim 46, including valve means in a bypass line means for deactivating said heat exchanger to preclude reducing the temperature of the high pressure gas in said compression section means high pressure gas line.

48. A heat pump system according to claim 47, including sensor switch means for detecting temperature at a selected location in said compressor section means and for actuating said valve means, whereby said heat exchanger is selectively deactivated.

49. A heat pump system comprising, compressor means for circulating a relatively high pressure gas working fluid, a high pressure gas working fluid line interconnecting a high pressure chamber of said compressor means and elements of a vapor compression cycle system, a low pressure gas working fluid line interconnecting said elements of a vapor compression cycle system and said high pressure chamber of said compressor means, compressor piston means in said compressor means for converting relatively low pressure gas working fluid to relatively high pressure gas working fluid in said high pressure chamber to one side of said compressor piston, a low pressure gas working fluid branch line connecting said low pressure gas working fluid line and a low pressure chamber in said compressor means to the other side of said compressor piston from said high pressure chamber, and power means operating on said compressor piston means in addition to the relatively low pressure gas working fluid from said low pressure working fluid branch line for pressurizing the relatively low pressure gas fluid in said high pressure chamber, said power means including piston means having power working fluid operating on one radial face thereof and said low pressure gas working fluid operating on another radial face of reduced area of said piston means.

50. A heat pump system according to claim 49, wherein said piston means is a hydraulic piston.

51. A heat pump system according to claim 49, wherein said piston means includes power piston means having said one radial face on which said power working fluid operates, drive piston means having said another radial face on which said low pressure gas working fluid operates, and connecting rod means joining said power piston means and said drive piston means.

* * * * *